US010932576B2

(12) United States Patent
Levin et al.

(10) Patent No.: US 10,932,576 B2
(45) Date of Patent: Mar. 2, 2021

(54) MASSAGE CHAIRS WITH LOCKING MECHANISMS

(71) Applicant: FIUS Distributors, LLC, Boulder, CO (US)

(72) Inventors: Clifton Lee Levin, Boulder, CO (US); Kiyoyuki Okuyama, Yamagata (JP); Yoichi Hirata, Kanagawa (JP); Kazuhide Maeda, Kanagawa (JP); Masaki Kagano, Kawaguchi (JP)

(73) Assignee: FIUS DISTRIBUTORS, LLC, Boulder, CO (US)

( * ) Notice: Subject to any disclaimer, the term of this patent is extended or adjusted under 35 U.S.C. 154(b) by 12 days.

(21) Appl. No.: 16/531,472

(22) Filed: Aug. 5, 2019

(65) Prior Publication Data

US 2020/0046127 A1 Feb. 13, 2020

Related U.S. Application Data

(60) Provisional application No. 62/715,352, filed on Aug. 7, 2018.

(51) Int. Cl.

| | |
|---|---|
| ***A47C 7/54*** | (2006.01) |
| ***A47C 1/03*** | (2006.01) |
| *A47C 7/72* | (2006.01) |

(52) U.S. Cl.

CPC ..... *A47C 7/543* (2013.01); *A47C 1/0308* (2018.08); *A47C 7/725* (2013.01); (Continued)

(58) Field of Classification Search

CPC ..... A47C 7/543; A47C 7/725; A47C 1/0308; A61H 2201/0149; A61H 2205/10; A61H 2205/06; A61H 2201/0192

See application file for complete search history.

(56) References Cited

U.S. PATENT DOCUMENTS 1,478,640 A * 12/1923 Coverly ..... A47C 7/34 297/452.59
1,752,078 A * 3/1930 Hamilton ..... A47C 7/725 297/217.6

(Continued)

FOREIGN PATENT DOCUMENTS

GB 2455092 B 6/2009
JP 2008245968 10/2008

OTHER PUBLICATIONS

ChampionChair [online], [retrieved on Aug. 7, 2019]. Retrieved from the Internet: <http://championchair.com/85-Series-Manual>, 2 pages.

(Continued)

*Primary Examiner* — Syed A Islam
(74) *Attorney, Agent, or Firm* — Bryan Cave Leighton Paisner LLP

(57) ABSTRACT

This disclosure relates to improved massage chairs. The massage chairs can include arms that are configured to transition between a closed position and an open position to assist individuals with entering or exiting the massage chairs. The massage chairs can also be configured to transition between an upright position and a reclined position. A locking mechanism can secure the arms of the massage chairs in the closed position when the massage chairs are in the reclined position or when the massage chairs are transitioning from the upright position to the reclined position.

22 Claims, 23 Drawing Sheets

(52) U.S. Cl.
CPC ..... *A61H 2201/0149* (2013.01); *A61H 2201/0188* (2013.01); *A61H 2201/0192* (2013.01); *A61H 2203/0431* (2013.01); *A61H 2205/06* (2013.01); *A61H 2205/081* (2013.01); *A61H 2205/10* (2013.01)

(56) References Cited

U.S. PATENT DOCUMENTS

| | | | | |
|---|---|---|---|---|
| 6,550,857 | B1 | 4/2003 | Canton | |
| 6,832,991 | B1 | 12/2004 | Inada | |
| 9,216,134 | B2 | 12/2015 | Inada | |
| 9,622,935 | B2 | 4/2017 | Fukuyama | |
| D815,447 | S | 4/2018 | Horinoe | |
| 9,943,174 | B1 | 4/2018 | Jacobs | |
| 2009/0177128 | A1 | 7/2009 | Fukuyama | |
| 2015/0300627 | A1* | 10/2015 | Wang | F21S 9/02 108/23 |
| 2016/0008211 | A1 | 1/2016 | Yang | |
| 2016/0038367 | A1 | 2/2016 | Joung | |
| 2017/0181920 | A1 | 6/2017 | Okamoto | |
| 2017/0209088 | A1 | 7/2017 | Inada | |
| 2017/0258673 | A1 | 9/2017 | Inada | |
| 2017/0304141 | A1 | 10/2017 | Notsu | |
| 2017/0340856 | A1 | 11/2017 | Inada | |
| 2017/0348177 | A1 | 12/2017 | Inada | |
| 2017/0348179 | A1 | 12/2017 | Inada | |
| 2017/0348180 | A1 | 12/2017 | Inada | |
| 2017/0348188 | A1* | 12/2017 | Inada | A61H 23/0263 |
| 2017/0360641 | A1 | 12/2017 | Nakata | |
| 2018/0033437 | A1 | 2/2018 | Inada | |
| 2018/0133101 | A1 | 5/2018 | Inada | |

OTHER PUBLICATIONS

ChampionChair [online], [retrieved on Aug. 7, 2019]. Retrieved from the Internet: <http://championchair.com/85-Series-Power>, 2 pages.

ChampionChair [online], [retrieved on Aug. 7, 2019]. Retrieved from the Internet: <http://championchair.com/89-Series-Manual>, 2 pages.

ChampionChair [online], [retrieved on Aug. 7, 2019]. Retrieved from the Internet: <http://championchair.com/Ascent-Manual>, 2 pages.

ChampionChair [online], [retrieved on Aug. 7, 2019]. Retrieved from the Internet: <http://championchair.com/Concord-Manual>, 2 pages.

ChampionChair [online], [retrieved on Aug. 7, 2019]. Retrieved from the Internet: <http://championchair.com/Passage-Manual>, 2 pages.

1800Wheelchair [online], [retrieved on Aug. 7, 2019]. Retrieved from the Internet: <http://www.1800wheelchair.com/product/swingaway-arm-clinical-recliner/>, 12 pages.

Alderman Manufacturing [online], [retrieved on Aug. 7, 2019]. Retrieved from the Internet <https://aldermanacres.com/wp/fumiture/recliners-trendelenburg/>, 16 pages.

Michael Kearney [online], [retrieved on Aug. 7, 2019]. Retrieved from the Internet <http://www.michaelkearneymedicalfumiture.ie/reclining-chairs-gallery/>, 2 pages.

Stance Healthcare [online], [retrieved on Aug. 7, 2019]. Retrieved from the Internet <http://www.stancehealthcare.com/blog/2015/03/recliner-swing-arm-eases-patient-transfer/>, 3 pages.

Winco [online], [retrieved on Aug. 7, 2019]. Retrieved from the Internet <https://wincomfg.com/products/?swoof=1&product_cat=phlebotomy>, 8 pages.

Elaine Heng [online], [retrieved on Aug. 7, 2019]. Retrieved from the Internet <http://elaineheng.blogspot.com/2016/01/gelish-manicure-and-pedicure-at-vanity.html#more>, 56 pages.

QuickMedical [online], [retrieved on Aug. 7, 2019]. Retrieved from the Internet <https://www.quickmedical.com/gendron-5233-bariatric-bed-side-commode-chair.html?sku=18779>, 1 page.

QuickMedical [online], [retrieved on Aug. 7, 2019]. Retrieved from the Internet <https://www.quickmedical.com/gendron-5233-bariatric-bed-side-commode-chair.html?sku=18778>, 1 page.

* cited by examiner

MASSAGE CHAIRS WITH LOCKING MECHANISMS

CROSS-REFERENCE TO RELATED APPLICATIONS

This application claims benefit of, and priority to, U.S. Provisional Application No. 62/715,352 filed on Aug. 7, 2018. The content of the above-identified application is herein incorporated by reference in its entirety.

TECHNICAL FIELD

The present disclosure is related to massage chairs and, more particularly, to massage chairs that have locking mechanisms for securing arms of the massage chairs.

BACKGROUND

Electronic massage chairs can include various massaging components that enable individuals to receive a mechanical or robotic massage. For example, an electronic massage chair typically includes a seat, and the massaging components incorporated into the massage chair can be activated or programmed to massage the individual's body while he or she is seated on the massage chair. However, entering or exiting the massage chairs can be difficult in many cases. This is especially true if the massage chairs are designed to include leg rest and arm rest portions which, in some cases, may require an individual to awkwardly extend their bodies, maneuver around them, or rely on upper body strength to enter or exit the massage chairs. Entering or exiting such massage chairs can be particularly difficult for elderly or disabled individuals, or anyone else whose mobility may be limited. Individuals can be injured if they fall or trip while entering or exiting the massage chairs. Moreover, individuals are more generally at increased risk of injury when a massage chair is in a reclined position because they may roll or fall out, especially when attempting to exit or enter the massage chair.

Additionally, many individuals often utilize massage chairs in a dark environment to enhance relaxation and their massage experience. The darkened environment can reduce visibility and increase the likelihood of injury when entering or exiting the massage chairs. For example, individuals exiting a massage chair in a dark environment properly discern the floor surface or may bump into portions of the massage chair as they exit the massage chair. Likewise, individuals entering the massage chair in a dark environment may not know how to appropriately mount the massage chair or position their bodies into the massage chair increasing, both of which increases the likelihood of injury.

Accordingly, there is a need for improved massage chairs that can be accessed and used with ease and in a safe manner.

BRIEF DESCRIPTION OF DRAWINGS

To facilitate further description of the embodiments, the following drawings are provided, in which like references are intended to refer to like or corresponding parts, and in which.

DETAILED DESCRIPTION OF EXEMPLARY EMBODIMENTS

Figure 1:
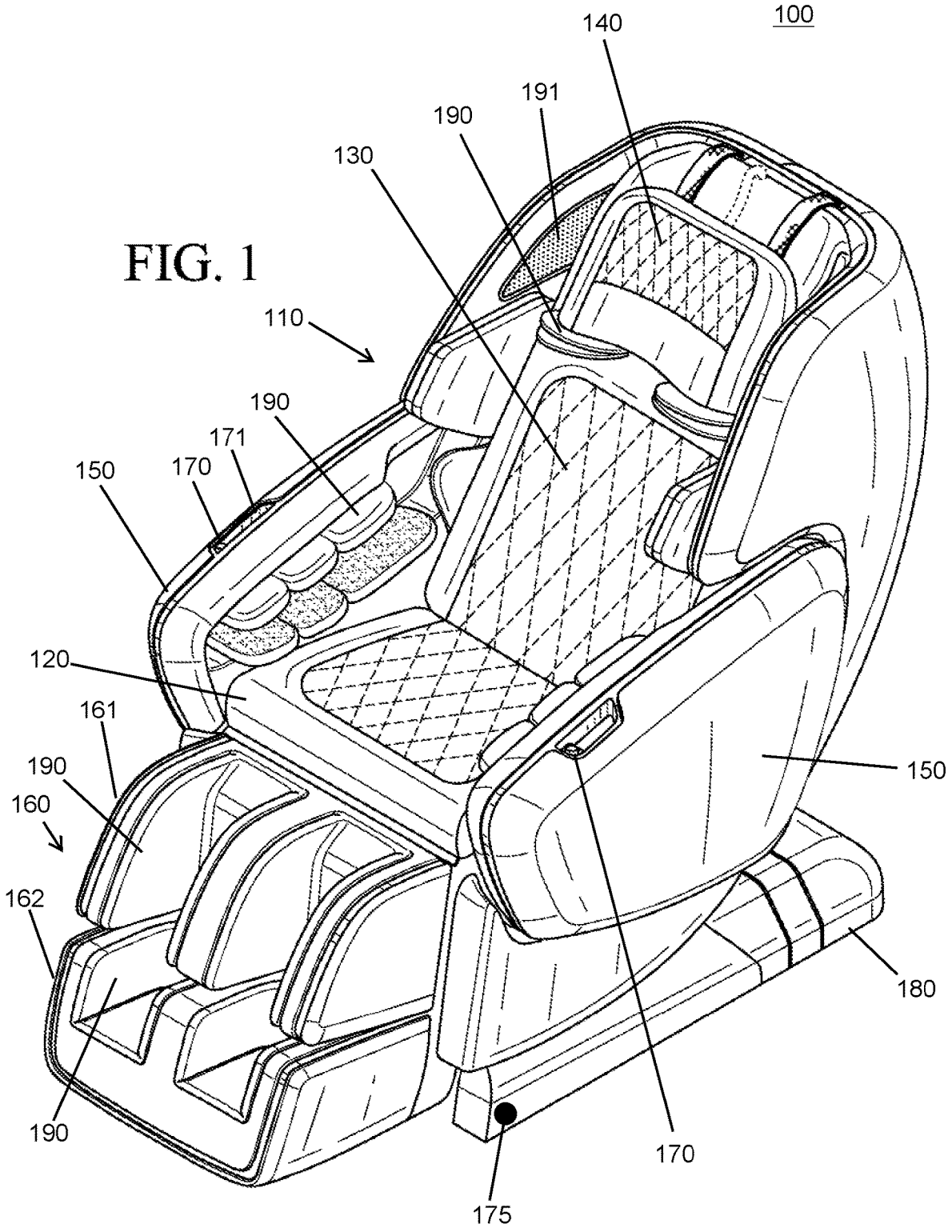
FIG. 1 is a front perspective view of an exemplary embodiment of the massage chair.
Figure 2:
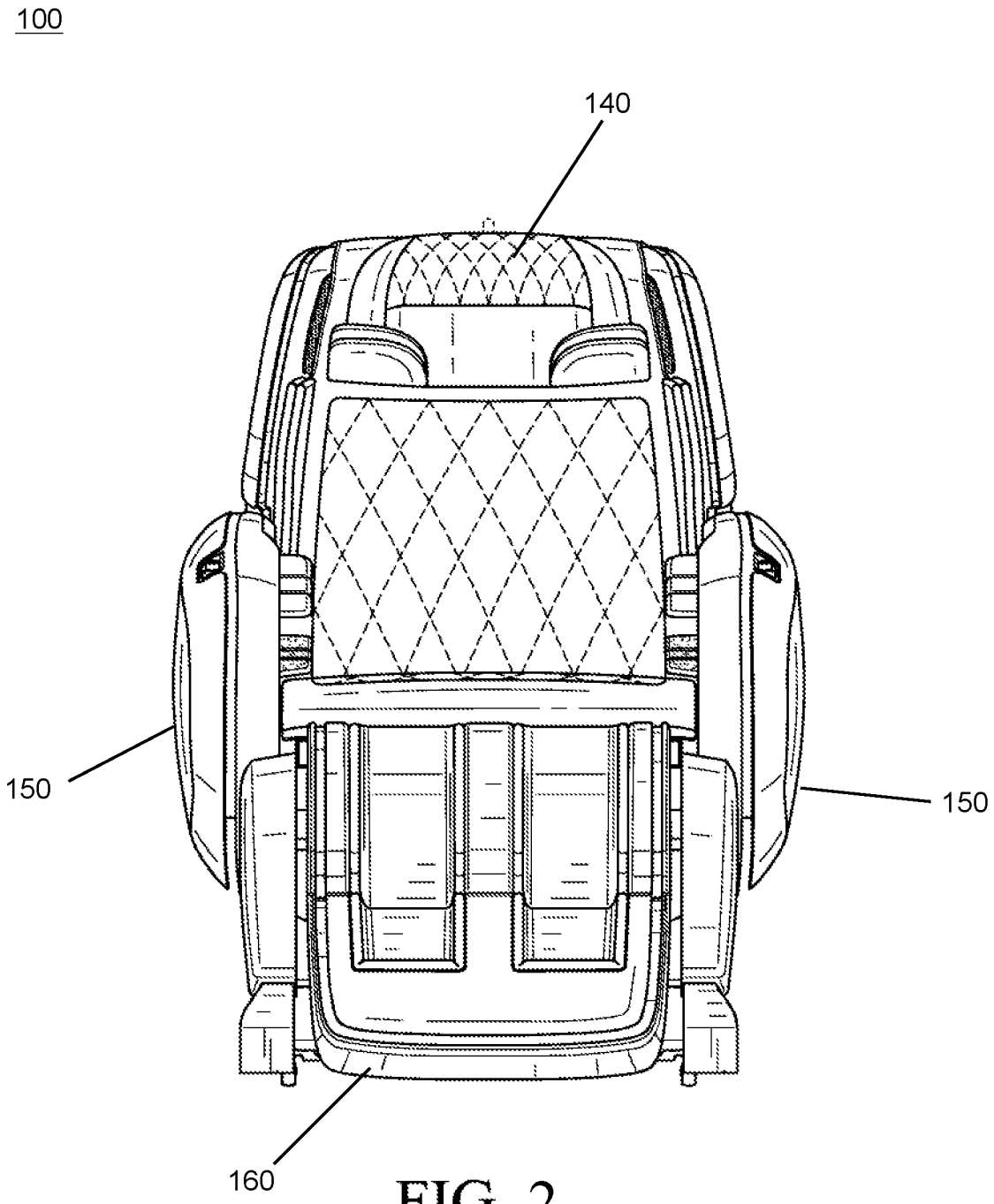
FIG. 2 is a front view of the massage chair in FIG. 1.
Figure 3:
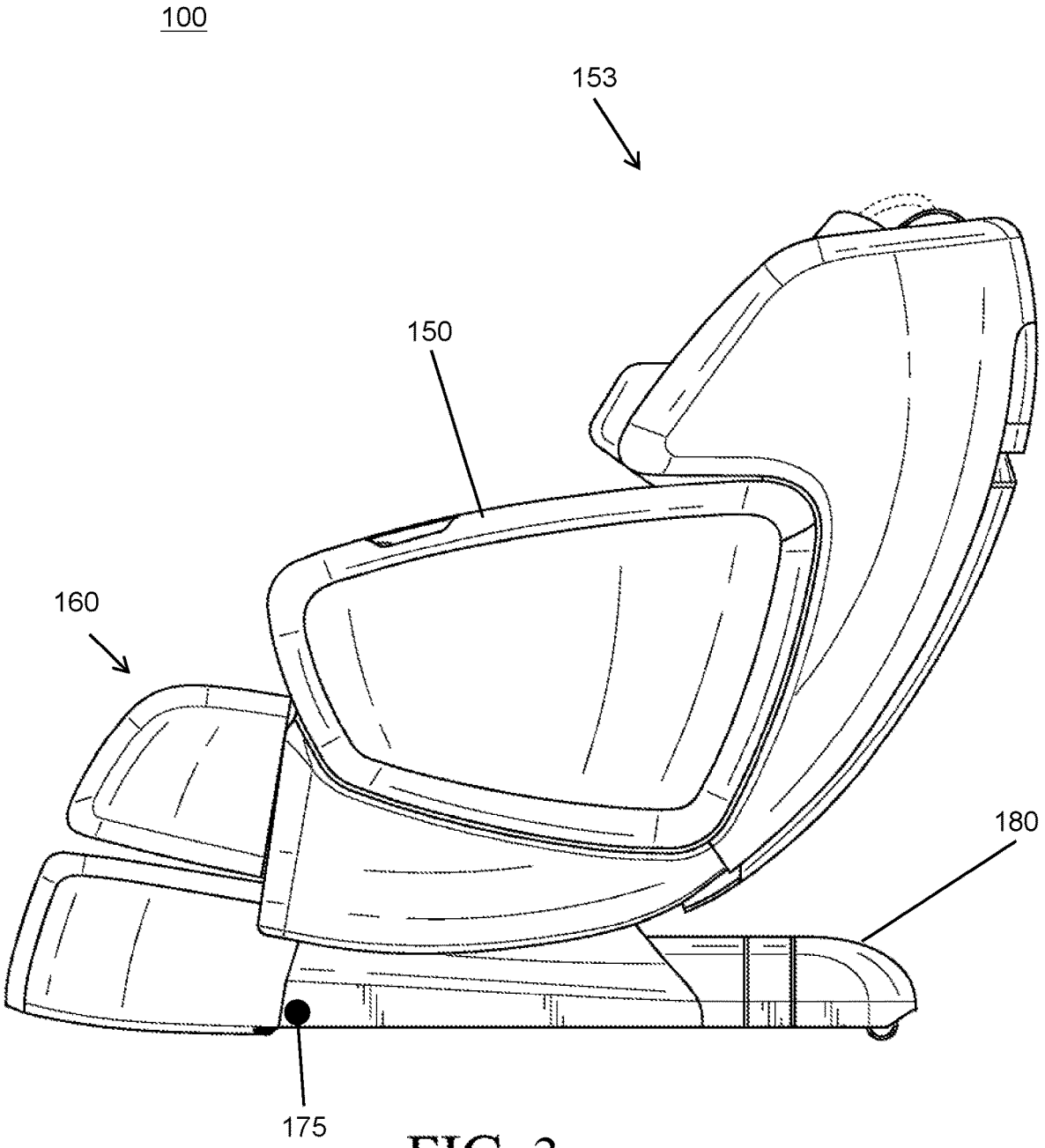
FIG. 3 is a side view of the massage chair in FIG. 1.
Figure 4:
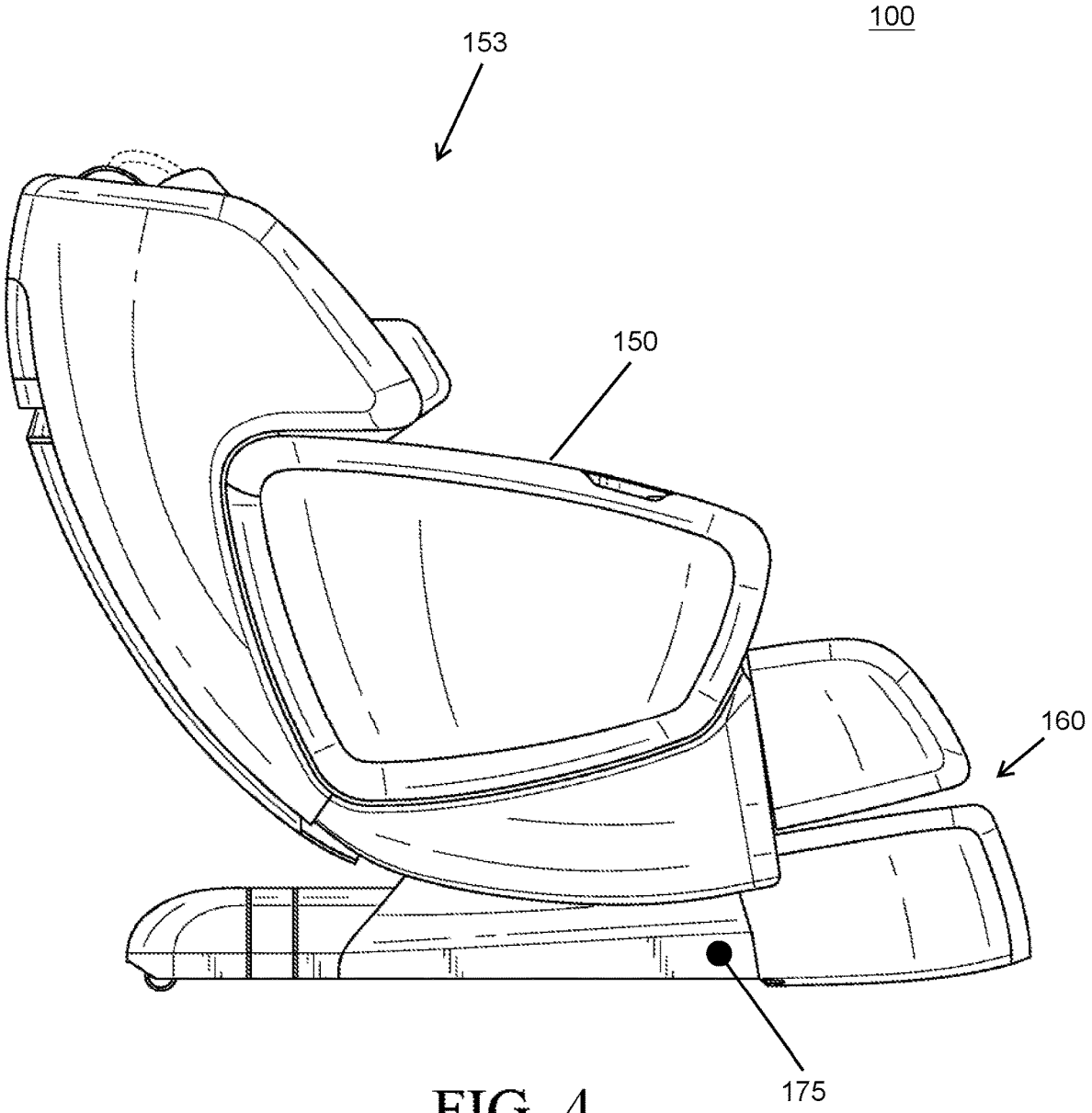
FIG. 4 is an opposite view of the massage chair in FIG. 1.
Figure 5:
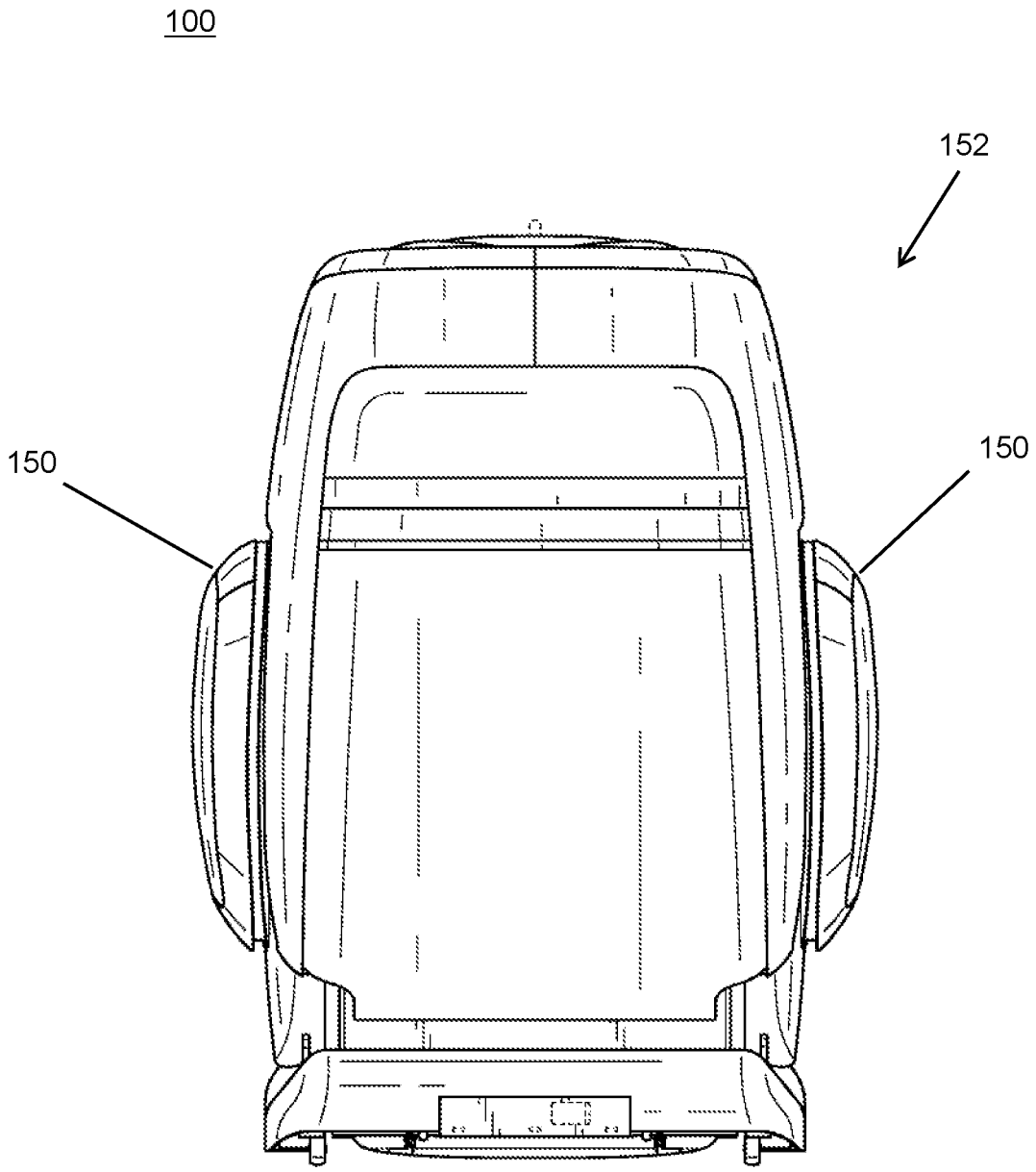
FIG. 5 is a rear view of the massage chair in FIG. 1.

The present disclosure is related to improved massage chairs, features, components, and associated methods. The improved massage chairs can include arms that are configured to transition between a closed position and an open position. Transitioning the arms of the massage chairs to the open position can permit individuals to more easily enter and exit the massage chairs. The massage chairs can also be configured to transition between an upright position and one or more reclined positions. Transitioning the massage chairs to the one or more reclined positions can provide a more comfortable and relaxing experience for individuals while utilizing the massage chairs. In certain embodiments, the massage chairs can include a locking mechanism that secures the arms of the massage chairs in the closed position in response to the massage chairs transitioning from the upright position to the one or more reclined positions. This locking mechanism serves as a safety feature that prevents or significantly decreases the likelihood that the individuals will fall or roll out of the massage chairs, or get injured while trying to enter or exit the massage chairs, particularly while the chair is arranged in one or more reclined positions or is transitioning from the upright position to the one or more reclined positions, and vice versa.

The manner in which the arms of the massage chairs are configured to transition between an open position and closed position can vary. In certain embodiments, arms of the massage chair may be connected to a base portion of the massage chair that includes a seat and a backrest. Each of the arms can be connected to the massage chair using at least two connection points. A first releasable connection can include a latching mechanism that enables the arms to be secured to the base portion of the massage chair near the seat when the arms are situated in the closed position. One or more release options (buttons, levers, or the like) located on the massage chair arms (or other portion of the massage chair) enable the first connection to be released or disengaged, and the chair arms to be rotated outwardly towards the open position. A second fixed connection permanently fixes the arms of the massage chair to the base portion near the backrest. The second connection allows the arms of the massage chair to rotate from the closed position to the open position, or vice versa, when the first connection is released. For example, the second connection can include a hinge that enables the massage chair arm to rotate horizontally (or substantially horizontally) with respect to the surface supporting the massage chair. Other configurations may also be utilized to enable the arms of the massage chairs to transition between the open position and the closed position.

In certain embodiments, the massage chair arms are able to slide or move horizontally, or substantially horizontally, in a lateral direction away from the base portion of the massage chair. Each of the massage chair arms may include an extension portion that is received inside the base portion of the massage chair when arranged in the closed position, and which extends outwardly when the chair arm is transitioned to the open position. Telescoping sliding rails may be incorporated into the base portion and the extension portion to permit the chair arm to transition between the open and closed positions. Each of the chair arms may include one or more casters, or other motion-enabling components, that can assist the chair arms with moving or sliding on an underlying surface that supports the massage chair.

As mentioned above, the massage chairs can also be configured to transition between an upright position and one or more reclined positions. When arranged in an upright position, the backrest is situated in a vertical fashion (e.g., such that it is arranged perpendicular, or substantially perpendicular, with respect to the seat). The massage chairs can include mechanical, electrical and/or electromechanical position-adjustment controls that enable the backrest to recline to one or more positions (e.g., such that the backrest is arranged more horizontally or substantially horizontally with respect to the surface supporting the massage chairs). The position-adjustment controls also permit the massage chairs to transition from the one or more reclined positions back to the upright position. In certain embodiments, the massage chairs can be configured to transition to one or more reclined positions simply by applying pressure in the direction of the backrest.

A locking mechanism is configured to secure the arms of the massage chair to the base portion of the massage chair (e.g., via the first releasable connection mentioned herein) when the massage chair transitions from the upright position to the one or more reclined positions. For example, if the arms of the chair are arranged in a closed position, an automated locking mechanism may prevent the arms from opening when the massage chair is transitioning or has transitioned from the upright position to the one or more reclined positions.

The configuration of the locking mechanism may vary. As discussed in further detail below, the locking mechanism can include a rotatable hook that prevents the massage chair arms from opening (e.g., by preventing a latching mechanism or other releasable connection from becoming disengaged). The locking mechanism may additionally, or alternatively, utilize magnets, solenoids, electromagnets, or the like to secure the chair arms to the base portion of the massage chair. The locking mechanism may additionally, or alternatively, include mechanical components that prevent movement of the chair arms. Other types of locking mechanisms may also be incorporated into the massage chairs including, but not limited to, manual locking mechanisms.

Similarly, in certain embodiments, if the arms of the chair are arranged in an open position, an automated locking mechanism may cause the arms to rotate towards the massage chair as the massage chair transitions to the one or more reclined positions. The inward rotation of the arms can cause the arms to contact the base portion of the massage chair near the seat and to automatically engage and secure the arms to the base portion.

As mentioned above, the arms and base portion of the massage chair can utilize any type of latching mechanism or other connection mechanism for securing the arms to the base portion. In certain embodiments, the arms and base portion include corresponding portions of releasable latching connections that enable the arms of the massage chair to be attached and detached from the base portion of the massage chair by pressing or engaging a release option (e.g., a button). For example, the base portion of the massage chair may include a male latching portion that is configured to engage a female latching portion located on the arms of the massage chair. In such embodiments, the locking mechanism that is used to secure the arms of the massage chair may include a hook that rotates and engages an opening in the latching mechanism when the chair is situated in a reclined position and/or when a user attempts to transition the massage chair to a reclined position. Insertion of the rotatable hook into the opening in the latching mechanism prevents the latching mechanism from releasing the arms of the chair even if an individual presses or engages the release option on the chair for releasing the arms.

Other configurations can be used for securing and/or locking the arms to the base portion of the massage chair. Regardless of the particular configuration utilized, the locking mechanism can serve as a safety feature that that prevents or significantly decreases the likelihood that the individuals will fall or roll out of the massage chairs, or get injured while trying to enter or exit the massage chairs (e.g., while the chair is arranged in one or more reclined positions or is transitioning from the upright position to the one or more reclined positions, and vice versa).

In certain embodiments, the massage chairs are outfitted with one or more motion-activated lights which provide additional safety features. The motion activated lights can include, or communicate with, one or more motion sensors that are able to detect movement in the vicinity of the massage chairs. For example, the motion-activated lights may be illuminated in response to detecting persons walking toward the massage chairs and/or exiting the massage chairs. This feature can be particularly useful in scenarios where the massage chairs are located in areas with poor lighting and/or when they are being utilized by individuals who may have poor vision (e.g., elderly or visually impaired persons).

In response to detecting motion, the motion-activated lights can be configured to provide illumination for a predetermined period of time (e.g., 10 seconds, 30 seconds, or 1 minute). The massage chairs can include controls for customizing settings associated with the motion-activated lights. For example, the controls may enable an individual to select options to keep the motion-activated lights on/off permanently, to activate/deactivate the motion sensing capabilities, to control motion detection sensitivity, and/or to customize other related features.

The massage chairs can be outfitted with other features as well. For example, the massage chairs may include a plurality of different massage components that are configured to massage various portions of individuals' bodies (e.g., arms, legs, back, neck, and/or other body portions). The massage chairs can also be outfitted with one or more speakers and/or one or more visual displays for outputting audio and/or video to individuals utilizing the massage chairs. The massage chairs can further include one or more universal serial buses (USBs) ports for connecting electronic devices (e.g., smart phones, laptops, cell phones, portable media players, and/or other electronic devices). In certain embodiments, any electronic devices connected to the USBs can be utilized to control the speakers, visual displays, and/or other features of the massage chairs. Additionally, the massage chairs can be powered using any type of alternating current (AC) and/or direct current (DC) electrical connection (e.g., by connecting the chairs to an electrical outlet and/or battery).

The embodiments described in this disclosure can be combined in various ways. Any aspect or feature that is described for one embodiment can be incorporated to any other embodiment mentioned in this disclosure.

FIGS. 1-22 disclose two exemplary massage chairs according to certain embodiments. Specifically, FIGS. 1-11 disclose a first exemplary massage chair 100 and FIGS. 2-22 disclose a second exemplary massage chair 100. The exemplary massage chairs 100 disclosed in these figures are not intended to be limiting in any manner whatsoever. Numerous modifications can be made to the massage chair as described in this disclosure.

Figure 27:
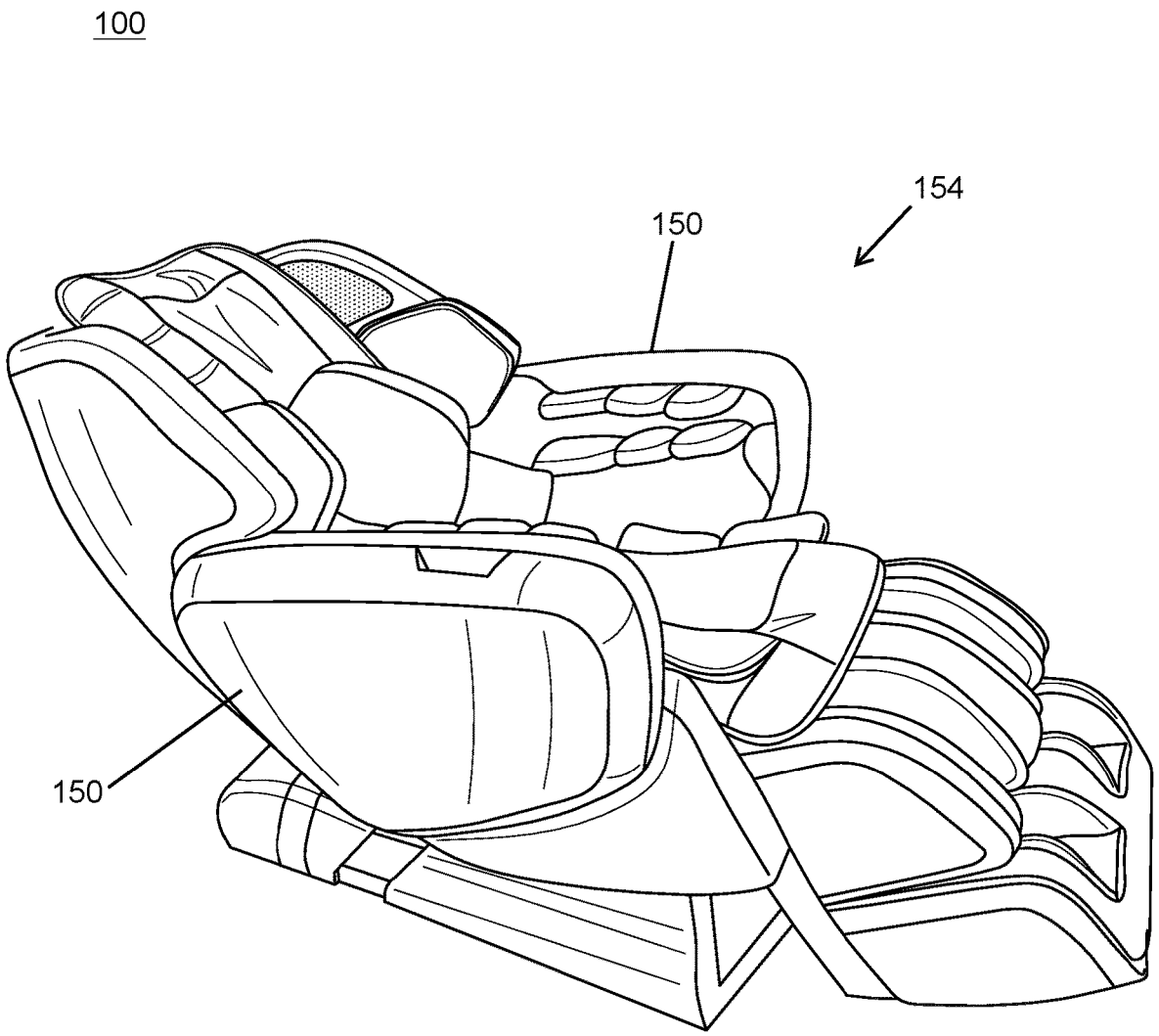
FIG. 27 is an example of a massage chair in a reclined position.

FIGS. 1-7 and 12-19 provide various views of the massage chairs with the arms 150 arranged in a closed position 152 and with the base portion 110 arranged in an upright position 153. FIGS. 8-9 and 19-20 provide various views of the massage chairs 100 with their arms 150 arranged in an open position 151 and with the base portion 110 arranged in an upright position 153. FIG. 27 illustrates an example of a massage chair 100 in a reclined position 154 with the arms 150 of the massage chair 100 in a closed position 152. Any of the massage chairs 100 described in this disclosure can include arms 150 that are configured to transition between an open position 151 and a closed position 152 and/or can include a base portion 110 that is configured to transition between an upright position 153 and a reclined position 154.

An exemplary massage chair may include a base portion 110 (e.g., which includes a seat 120, backrest 130, and a head section 140), a pair of arms 150, a leg rest 160, and a support portion 180. The leg rest 160 that may be comprised of two sections: a top section 161 that includes massage components 190 for massaging upper leg portions (e.g., thighs and calves) of an individual's legs; and lower section 162 that includes massage components 190 for massaging lower leg portions (e.g., ankles and feet) of an individual's legs. The leg rest 160 can be configured to rotate upward when the massage chair 100 transitions to one or more reclined positions 154 (e.g., as shown in FIG. 27). The base portion 110 of the massage chair 100 may include a seat section 120 and backrest 130 that is configured to receive an individual's body and a head section 140 or pillow section is located at the top of the backrest 130. In certain embodiments, the massage chair 100 may include a unitary cushion for the backrest 130 and seat portion 120 of the massage chair 100 that can be flipped over the back of the massage chair 100 and/or detached from the massage chair 100. In certain embodiments, the massage chair 100 can also include one or more audio speakers 191 that are integrated into the base portion 110 of the massage chair near the head section 140 or pillow section of the backrest 130.

Figure 6:
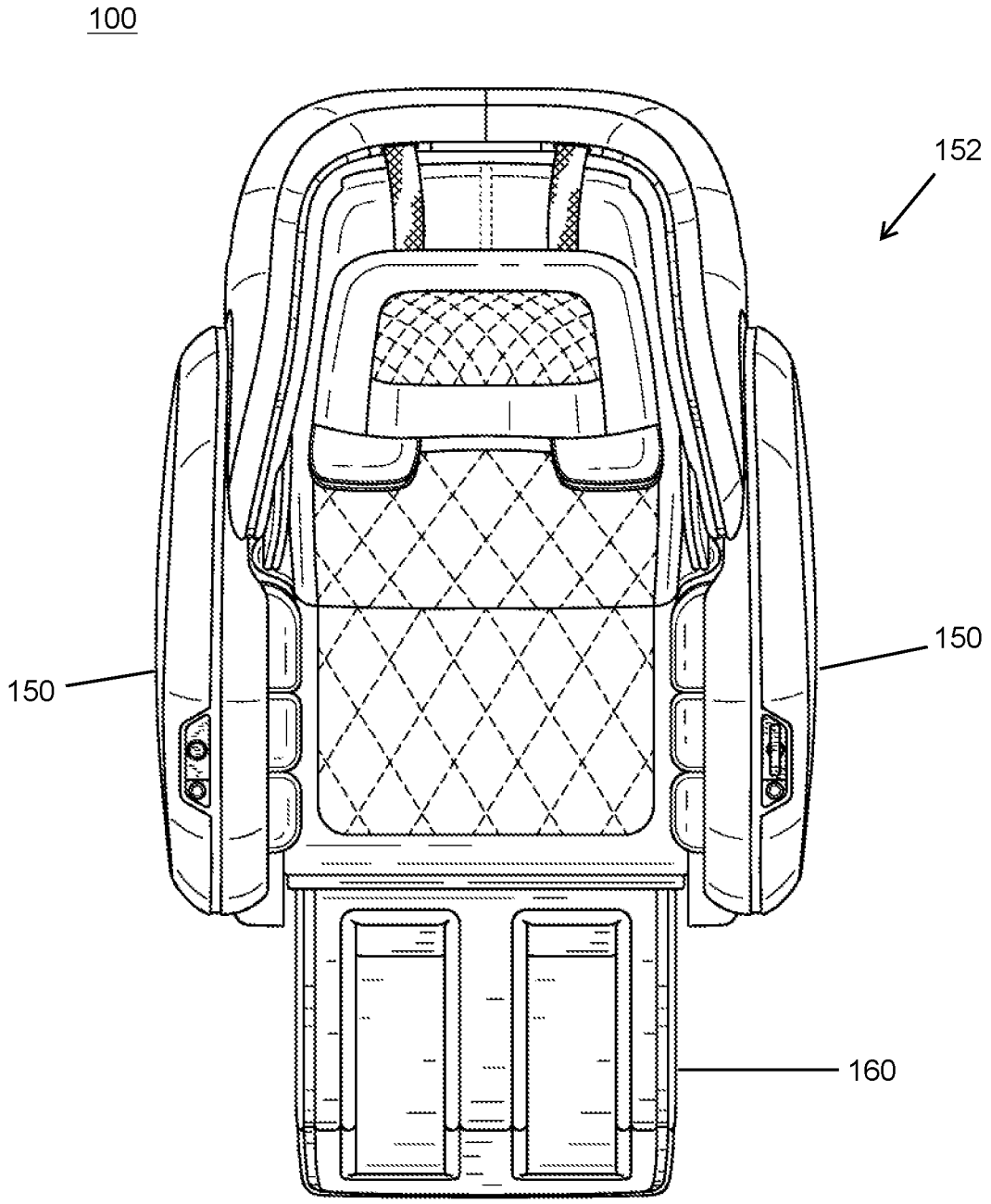
FIG. 6 is a top view of the massage chair in FIG. 1.
Figure 7:
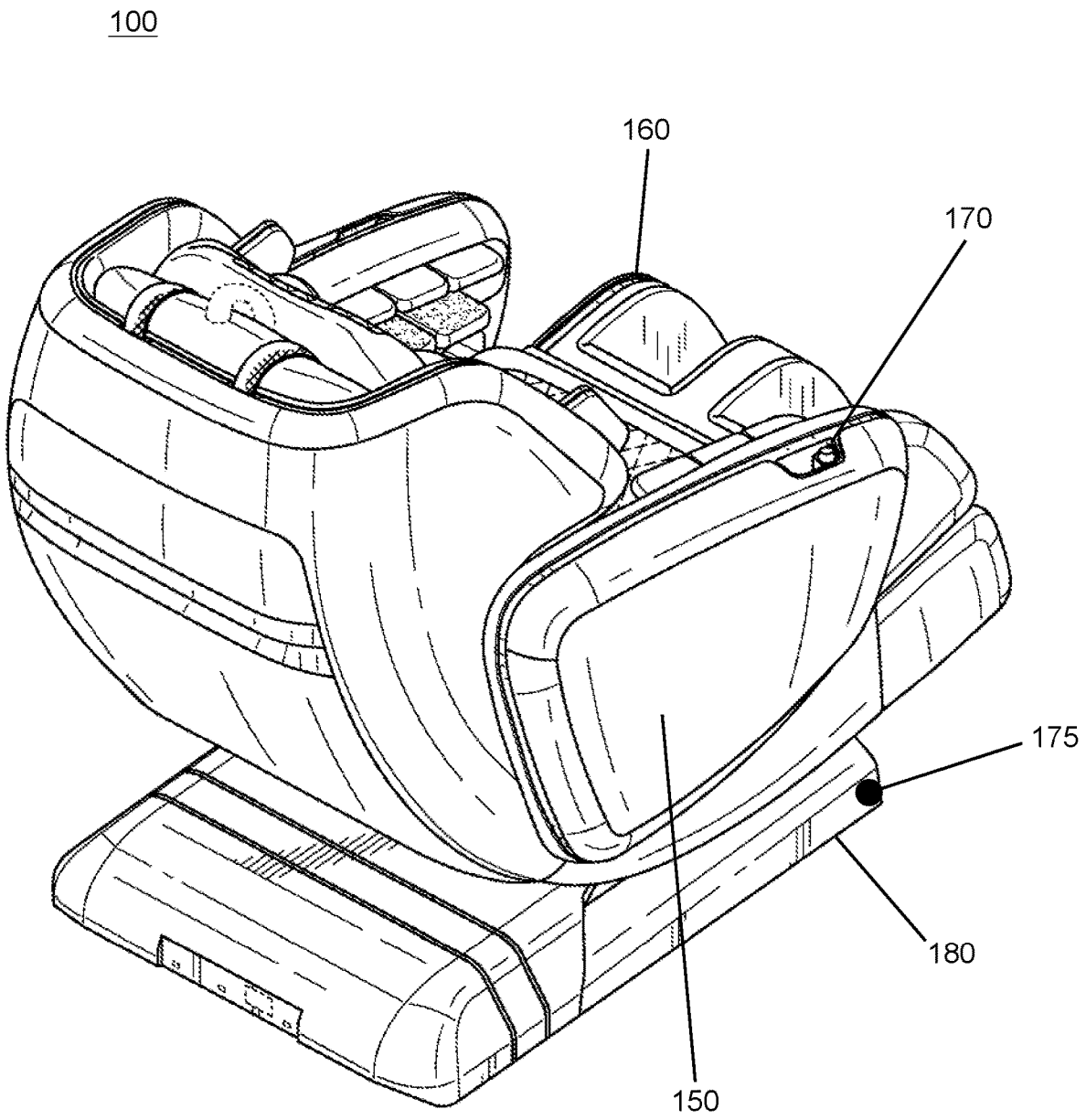
FIG. 7 is a rear perspective view of the massage chair in FIG. 1.
Figure 17:
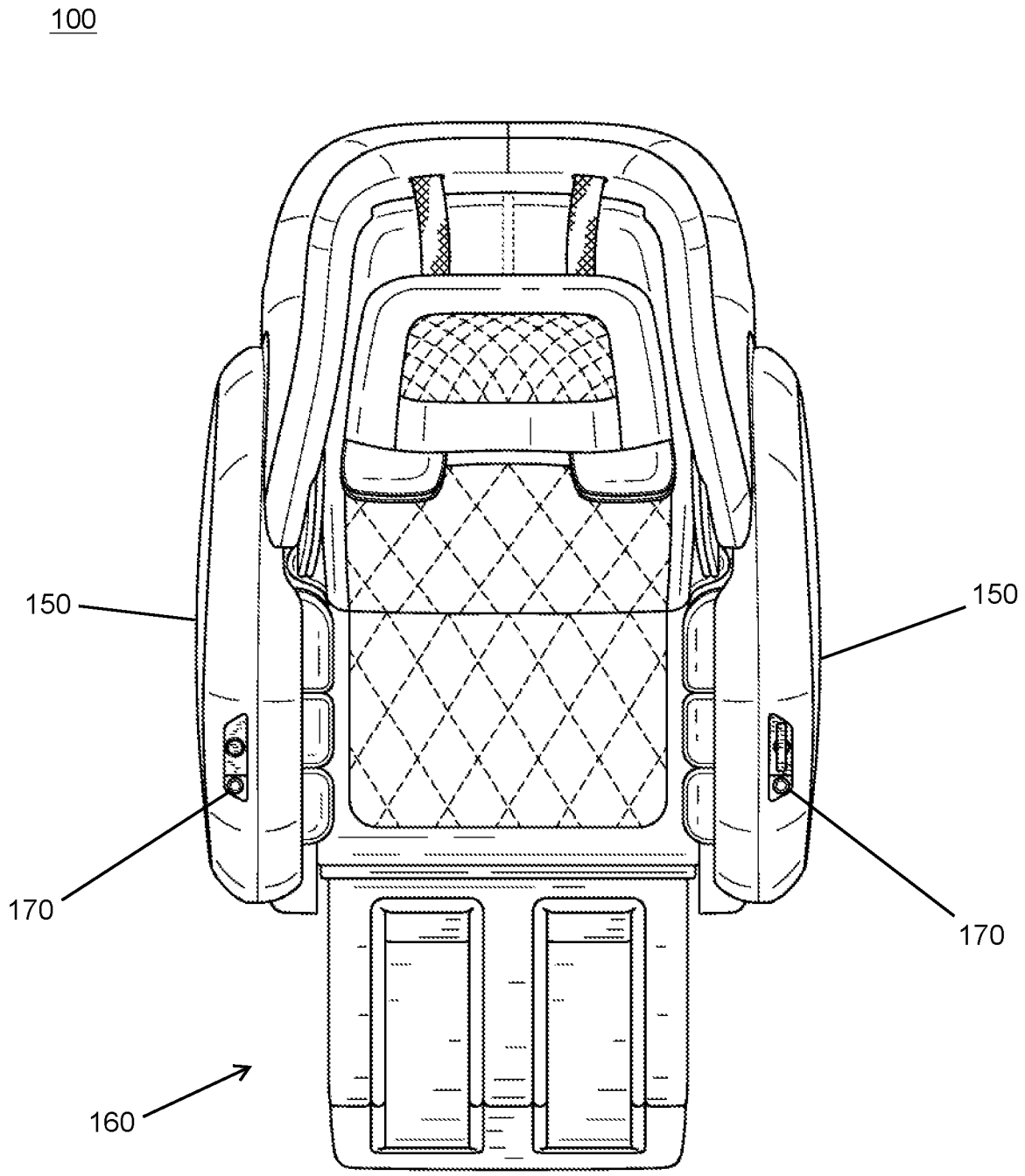
FIG. 17 is a top view of the massage chair in FIG. 12.
Figure 18:
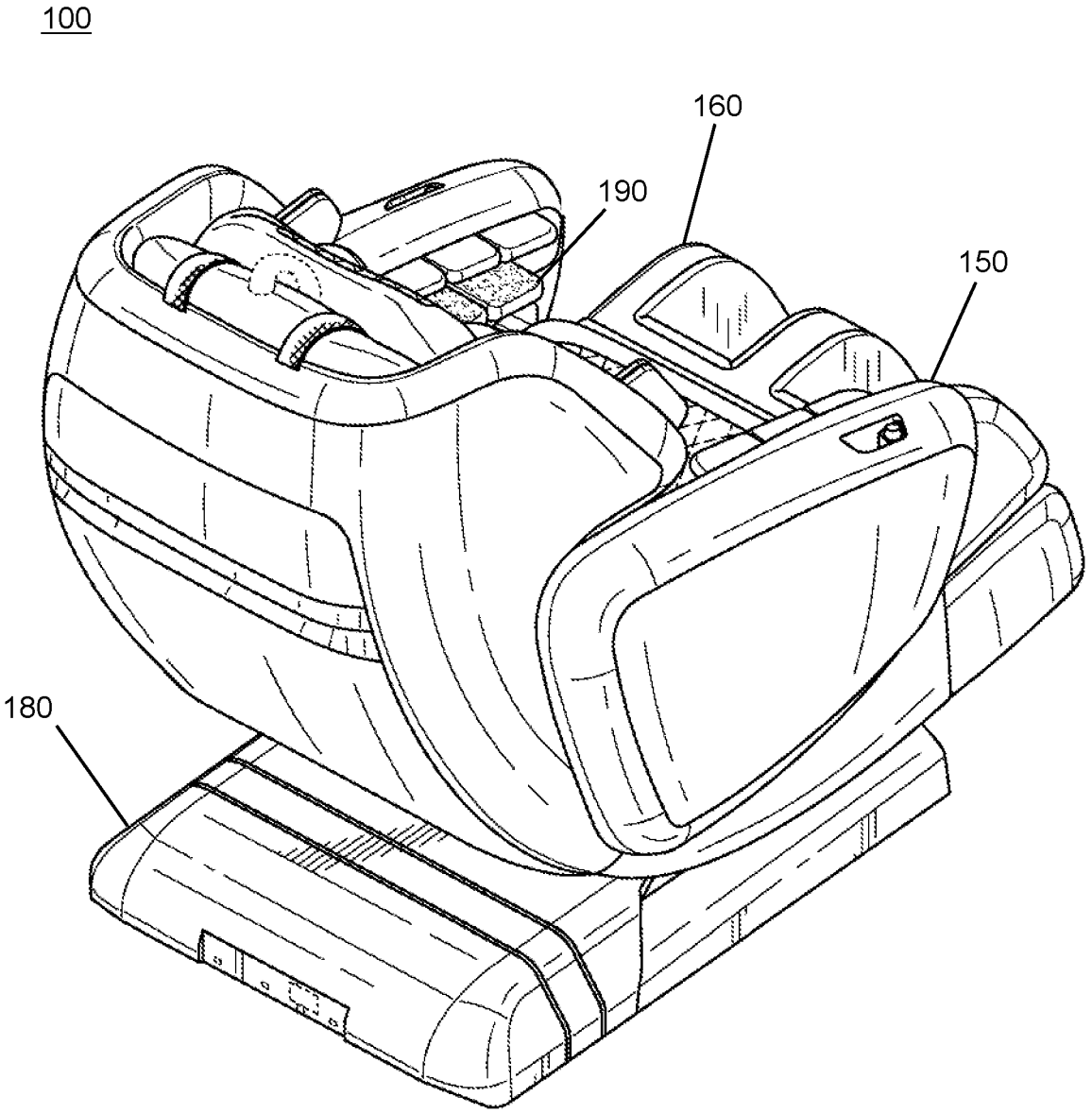
FIG. 18 is a rear perspective view of the massage chair in FIG. 12.

FIGS. 10-11 and 20-21 provide enlarged views showing interior portions of the massage chair arms 150 arranged in a closed position according to certain embodiments. As shown therein, the interior of the chair arms includes one or more USB ports and massage components 190 for receiving and massaging an individual's arms. FIGS. 6 and 17 provide top plans views of the massage chairs 100. As shown in these and other figures, the top of the chair arm 150 includes a release option 170 and a storage recess 171 (e.g., which can be used hold items while an individual is using the massage chair). Pressing the release option 170 allows the arms of the chair 100 to be released and transitioned to an open position 151 (e.g., as shown in FIGS. 8-9 and 19-20). As mentioned above, a locking mechanism may prevent the arms 150 from releasing when the chair 100 is in a reclined or declined position 154 and/or when an individual is attempting to move the chair to a reclined or declined position 154 (see FIG. 27 for an example of the massage chair in a declined position 154).

Figure 8:
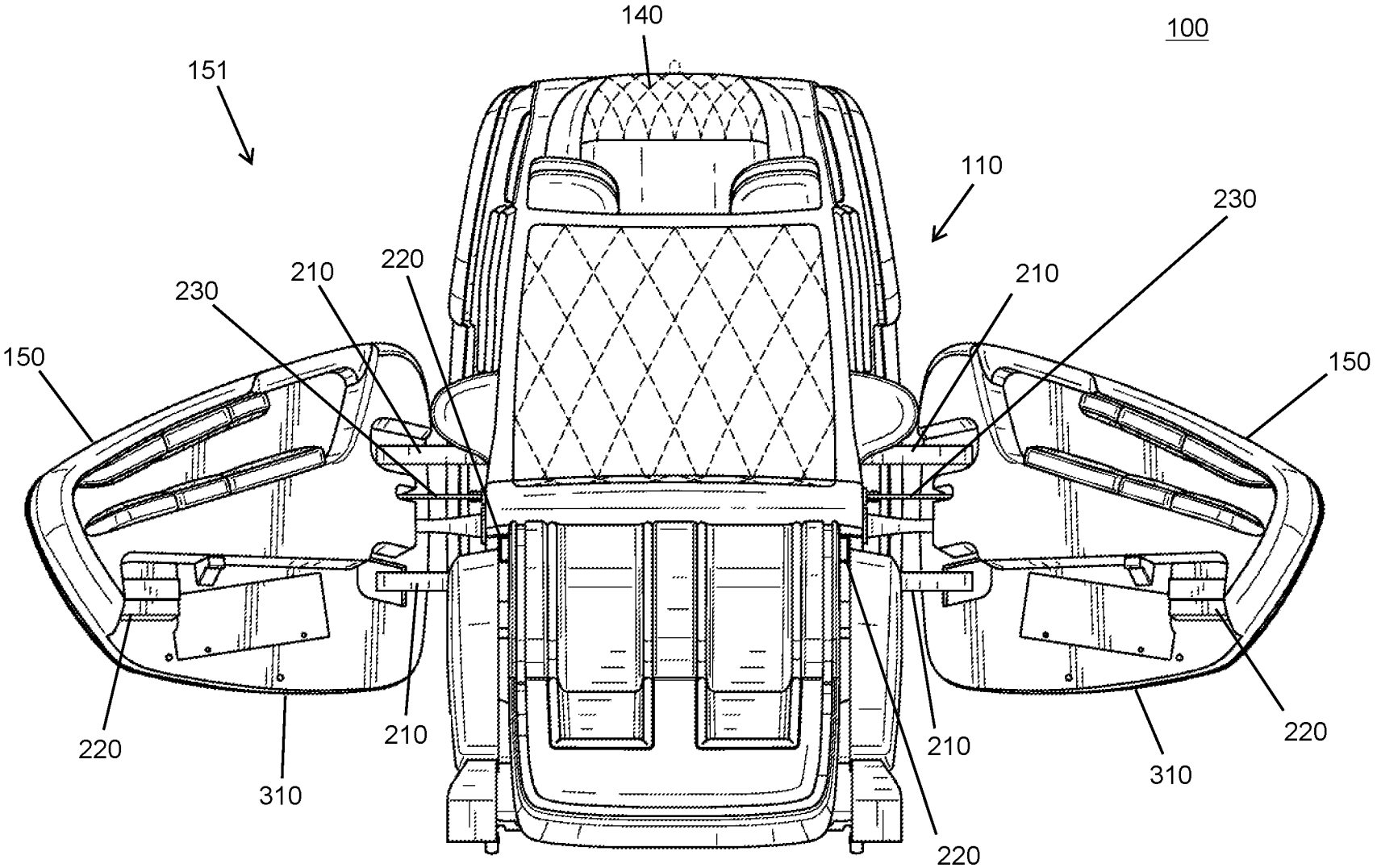
FIG. 8 is a front view of the massage chair in FIG. 1 showing arms of the massage chair in an alternate position.
Figure 9:
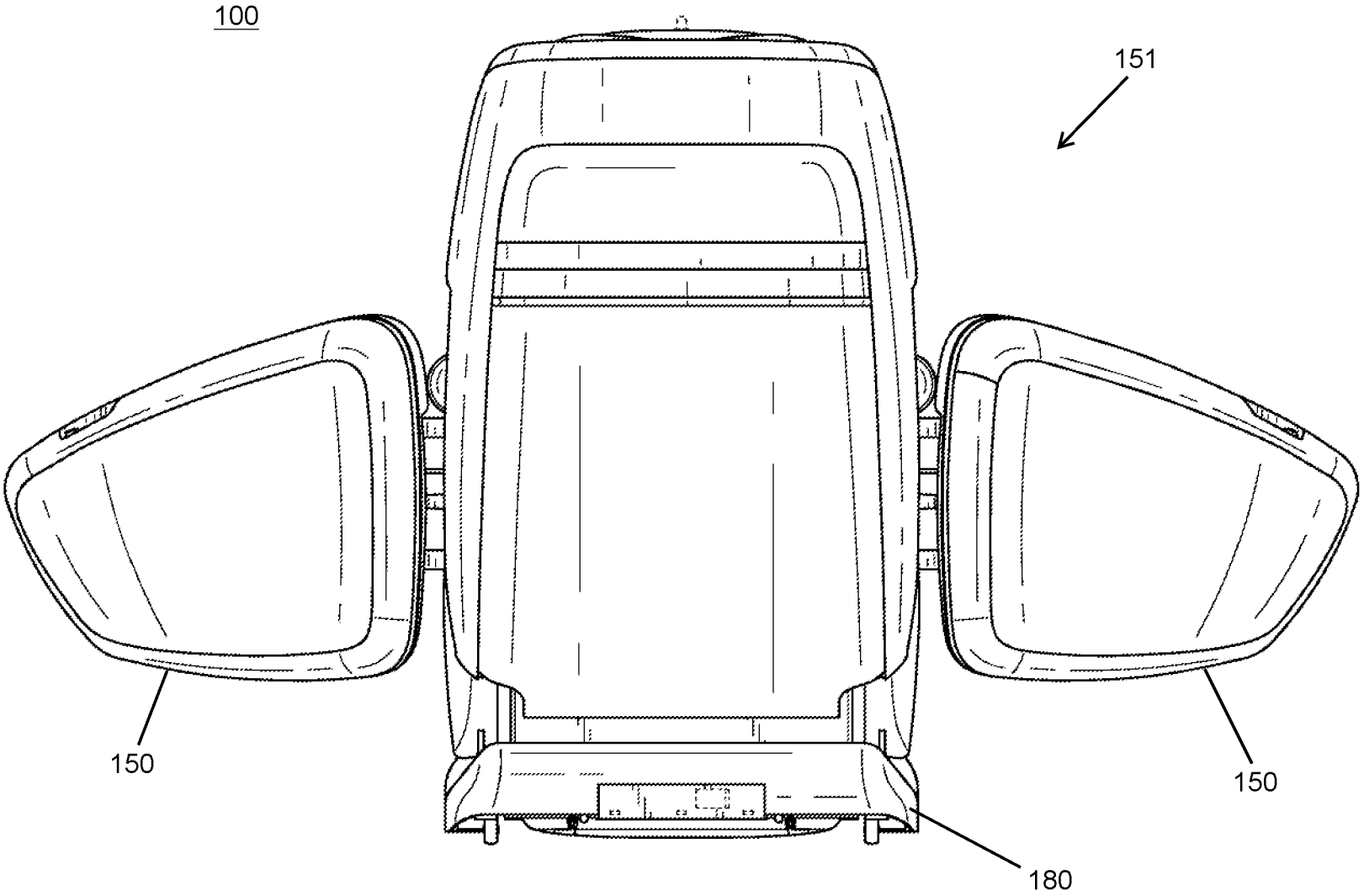
FIG. 9 is a rear view of the massage chair in FIG. 1 showing arms of the massage chair in an alternate position.
Figure 10:
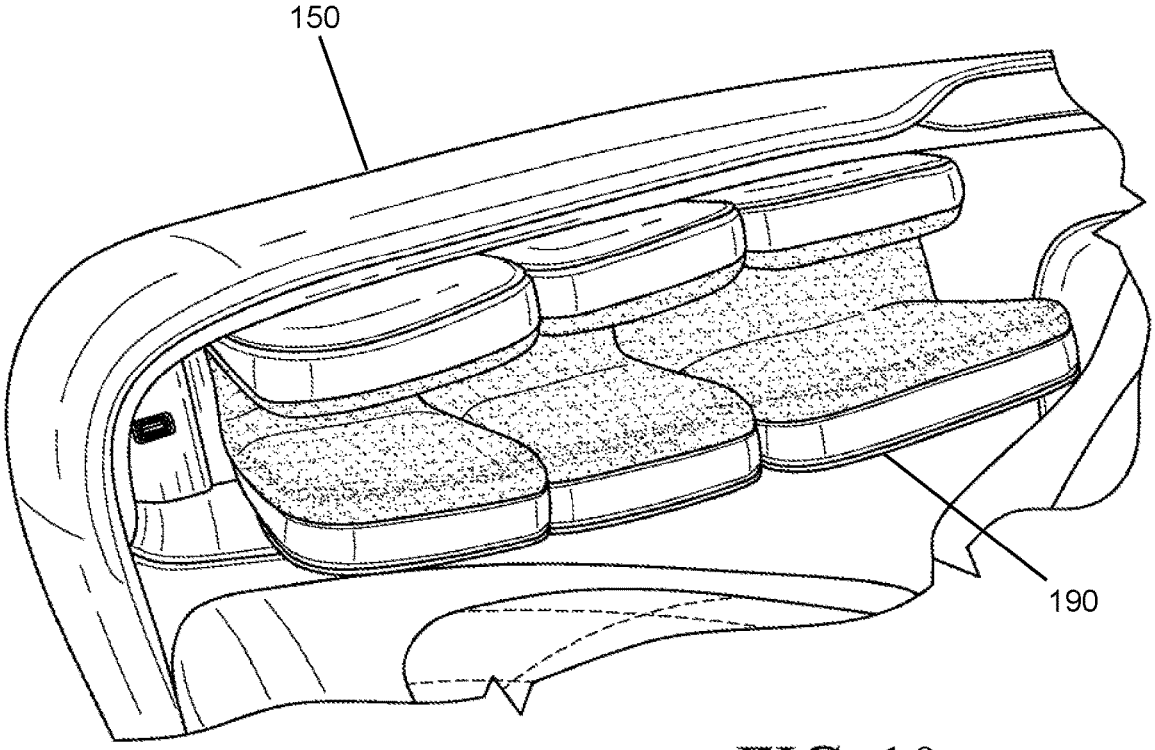
FIG. 10 is an enlarged, fragmentary view of the massage chair in FIG. 1 showing an inner portion of a right arm of the massage chair.
Figure 11:
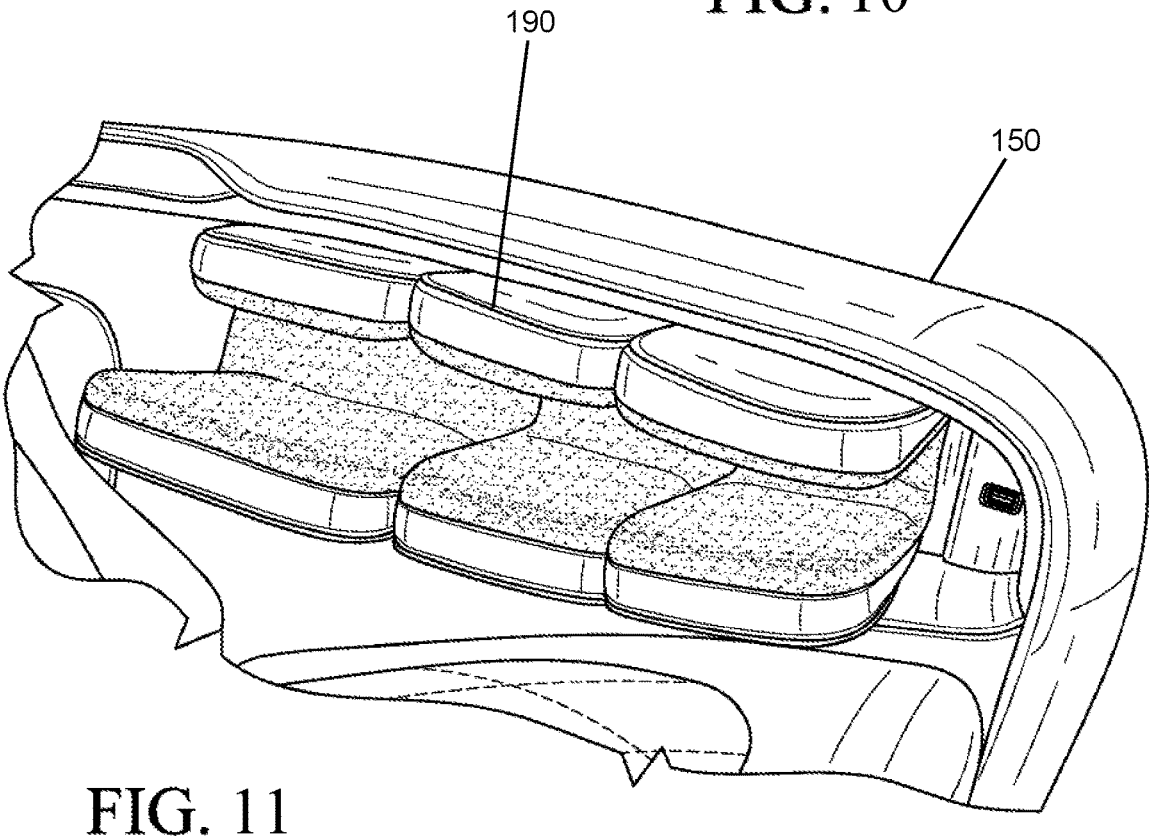
FIG. 11 is an enlarged, fragmentary view of the massage chair in FIG. 1 showing an inner portion of a left arm of the massage chair.
Figure 12:
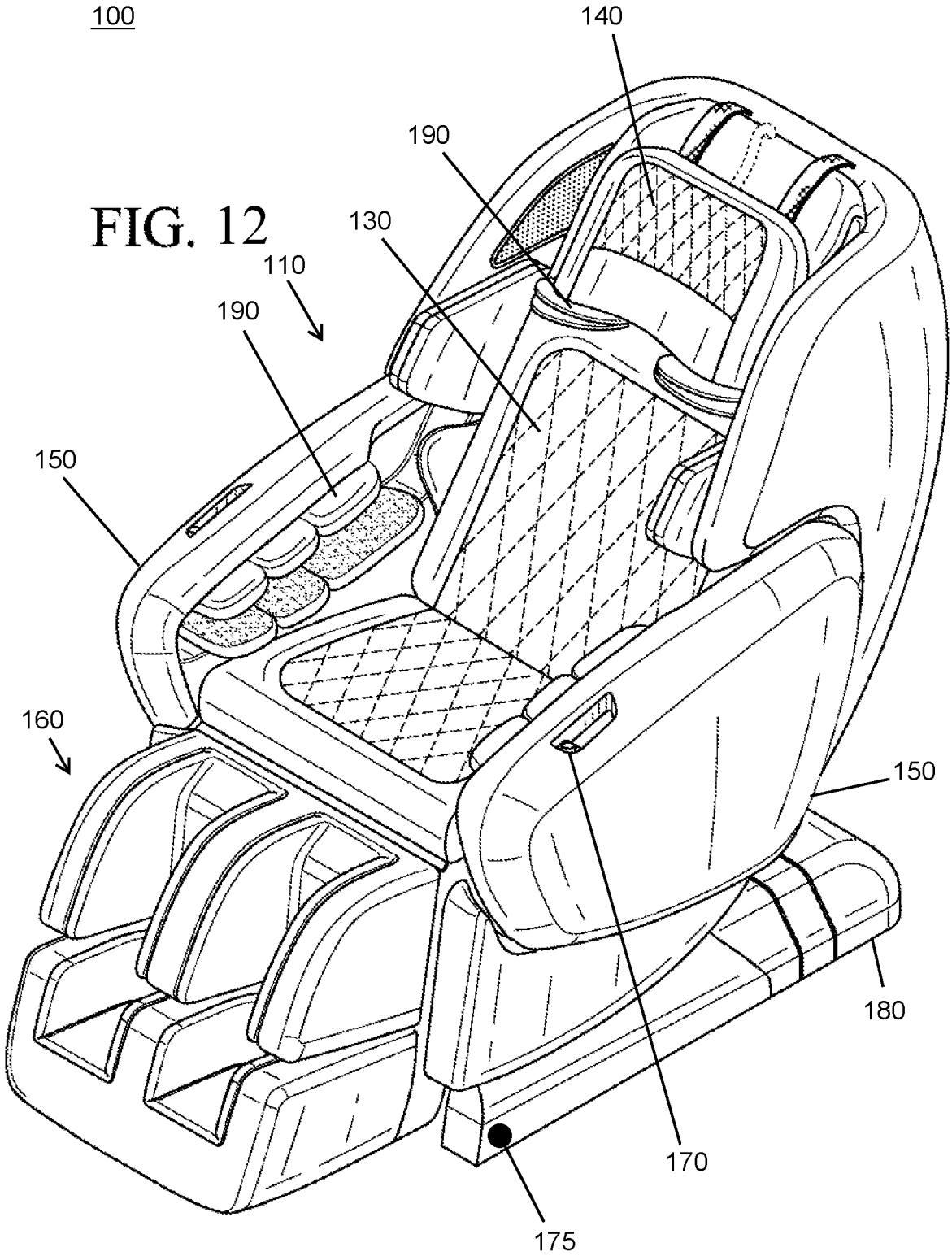
FIG. 12 is a front perspective view of another exemplary embodiment of a massage chair.
Figure 13:
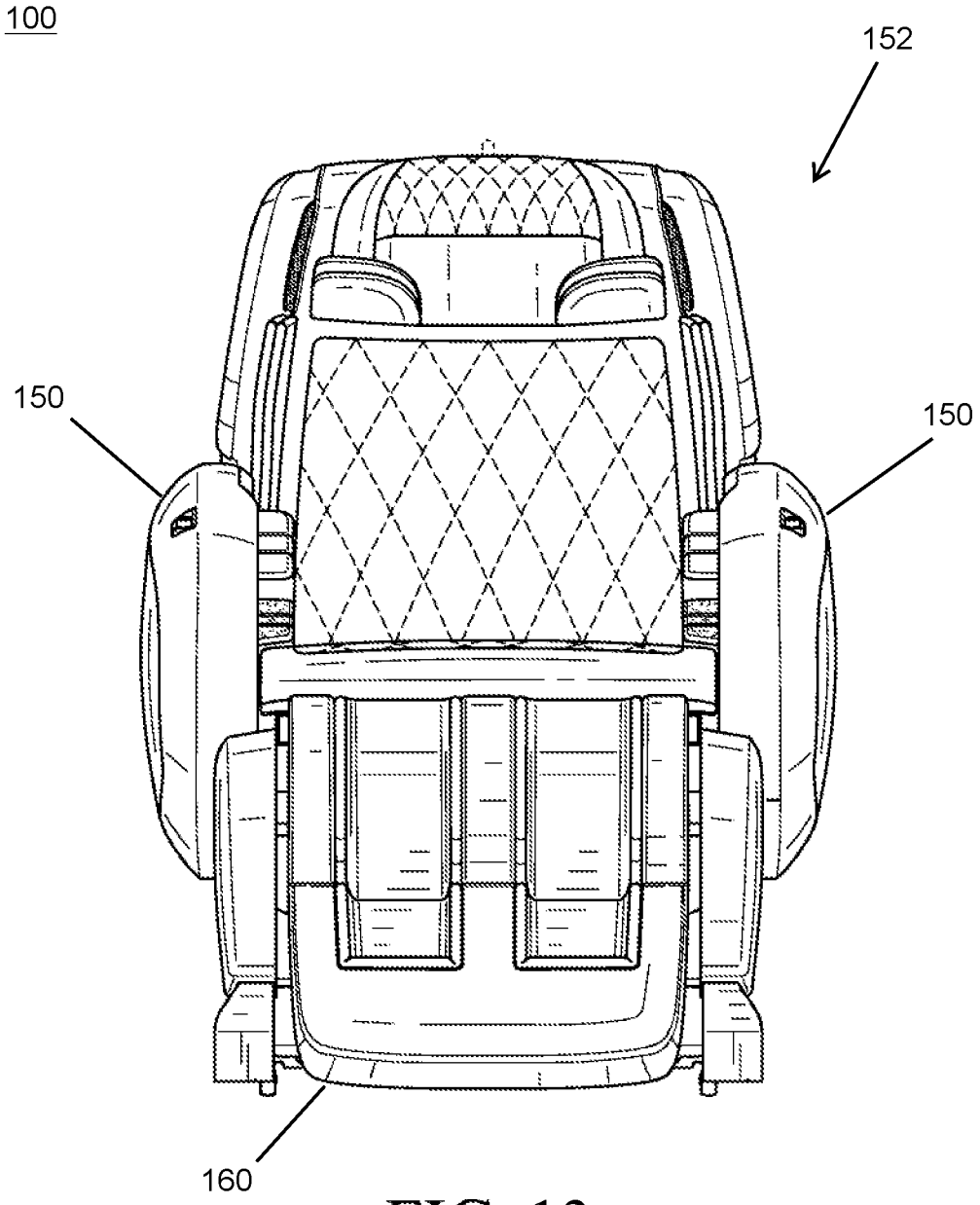
FIG. 13 is a front view of the massage chair in FIG. 12.
Figure 14:
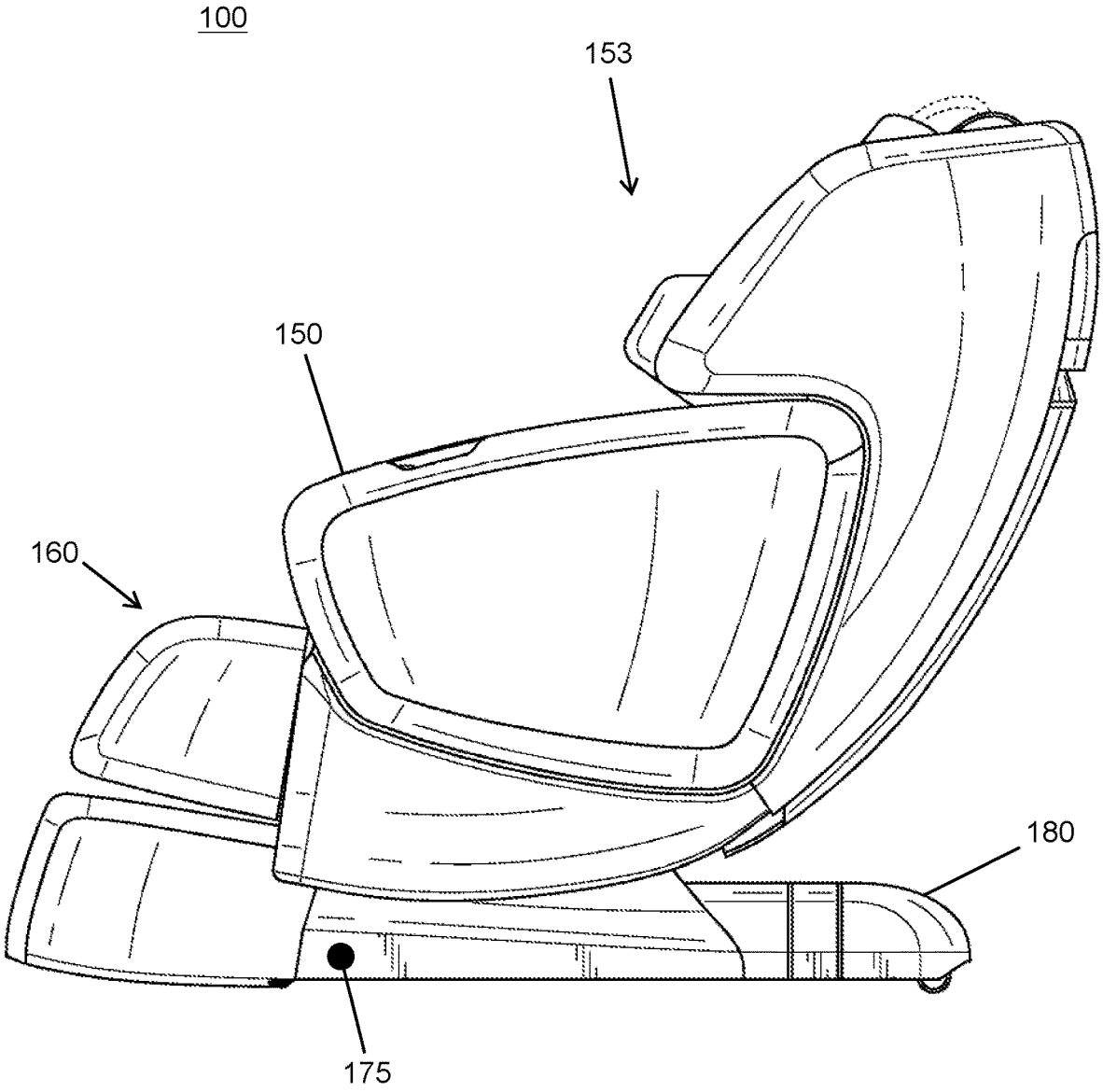
FIG. 14 is a side view of the massage chair in FIG. 12.
Figure 15:
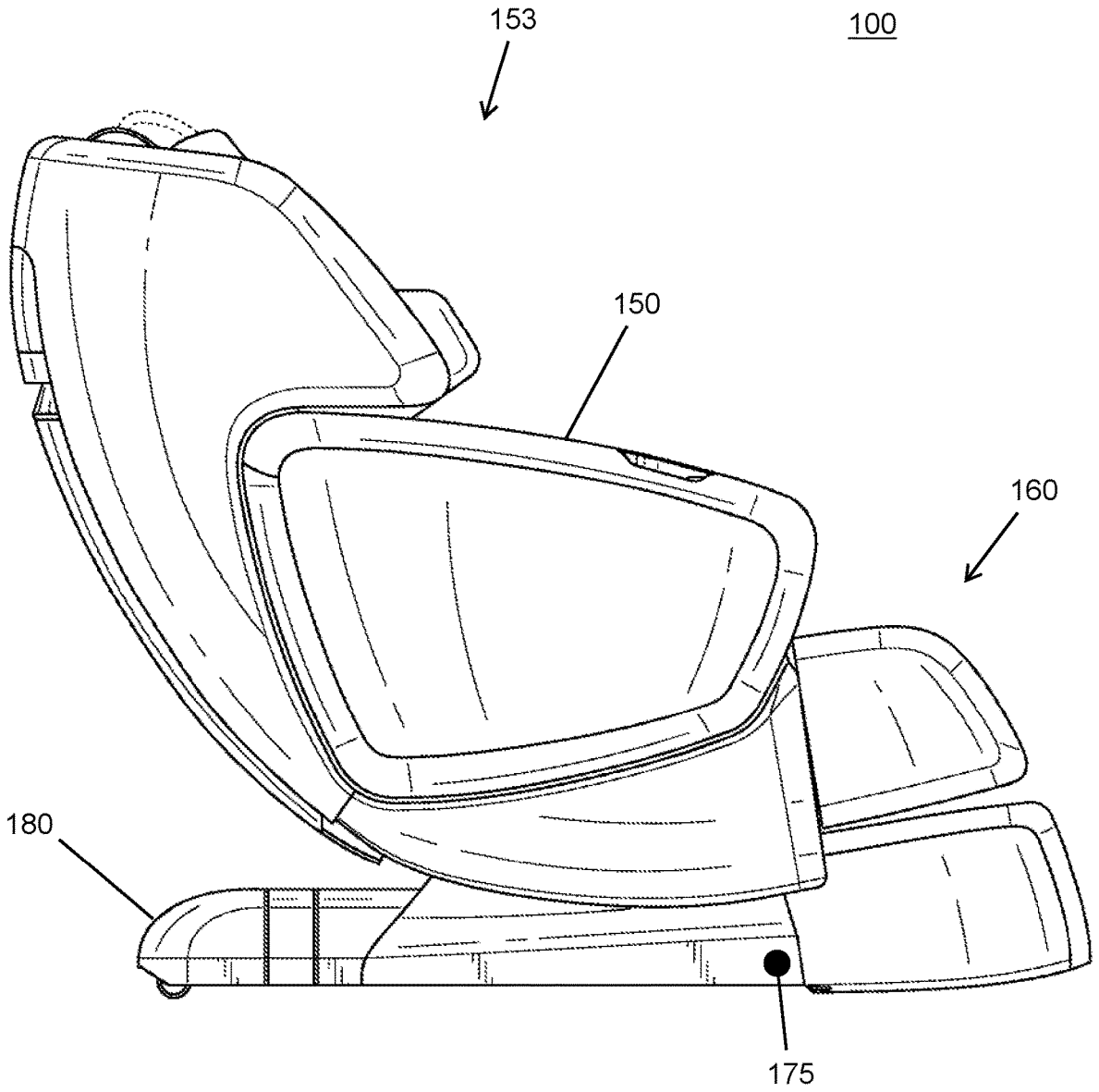
FIG. 15 is an opposite view of the massage chair in FIG. 12.
Figure 16:
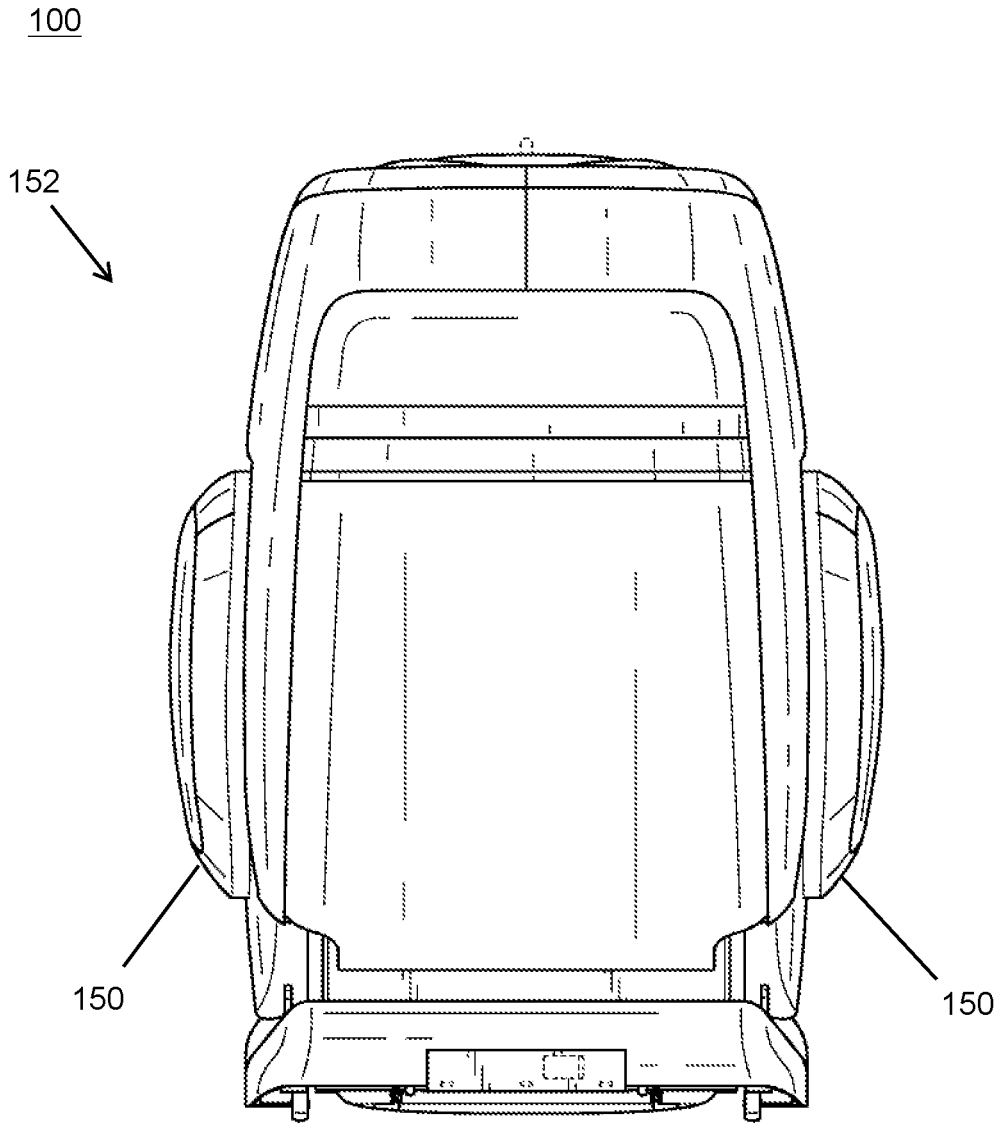
FIG. 16 is a rear view of the massage chair in FIG. 12.
Figure 19:
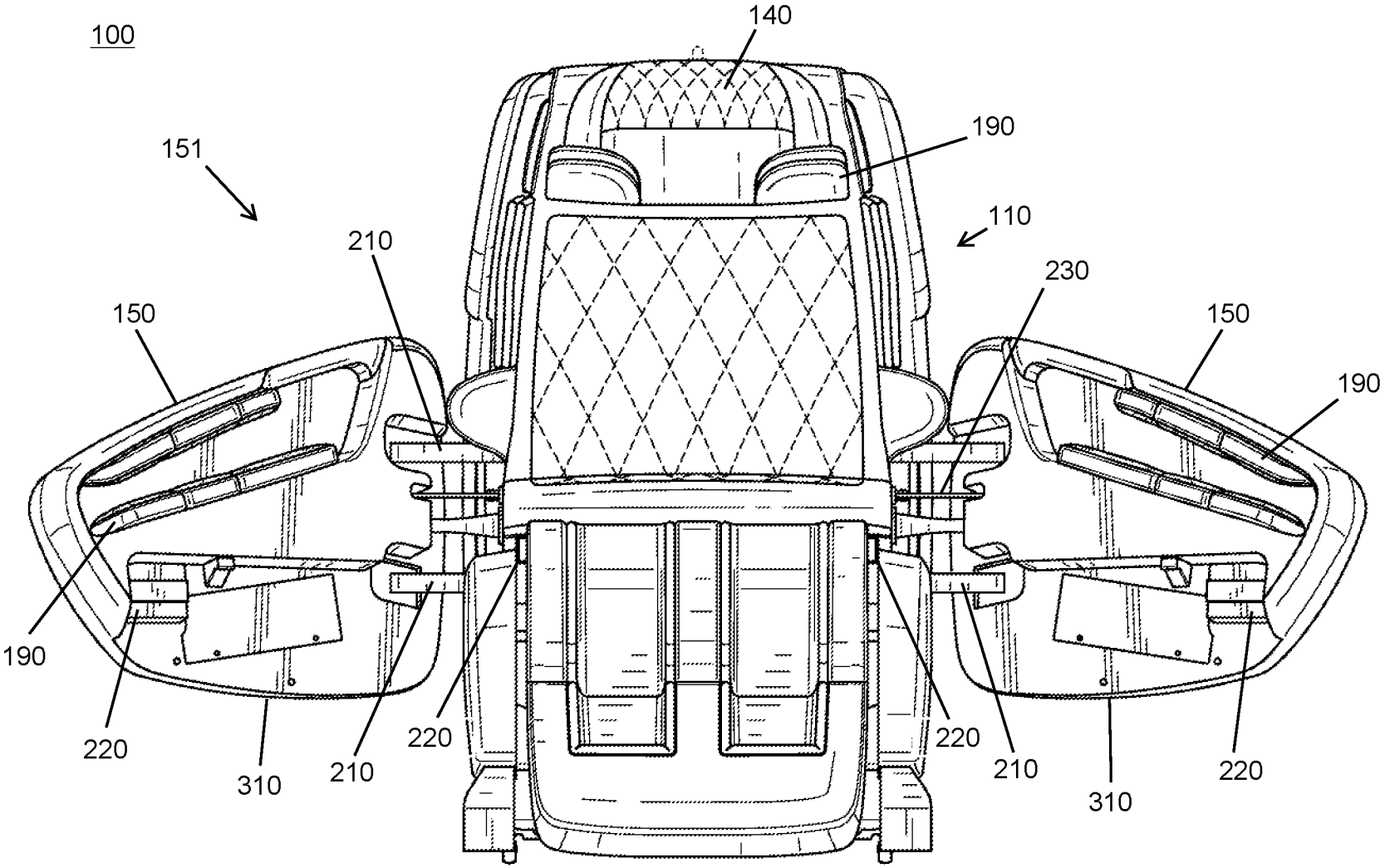
FIG. 19 is a front view of the massage chair in FIG. 12 showing arms of the massage chair in an alternate position.
Figure 20:
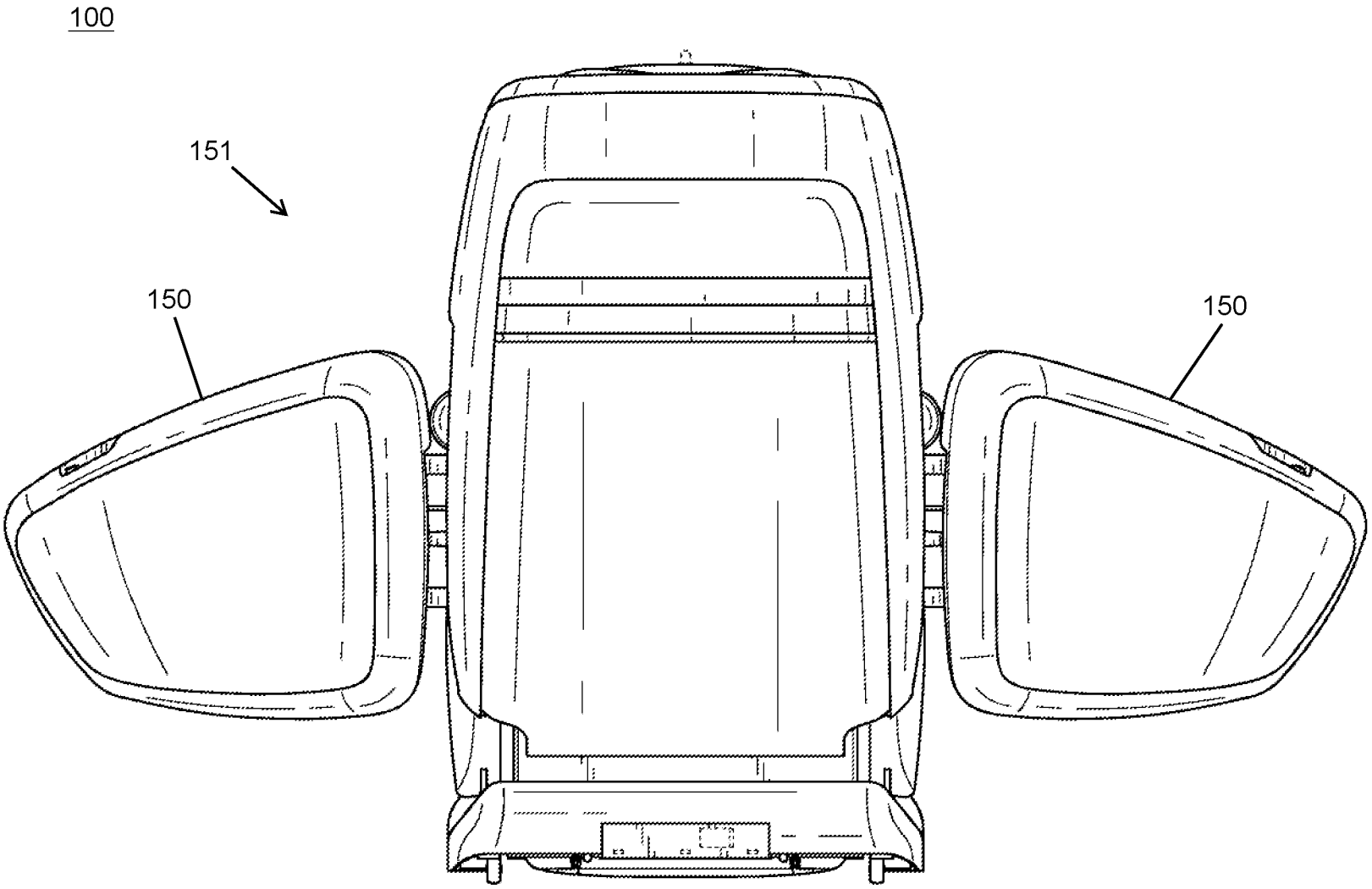
FIG. 20 is a rear view of the massage chair in FIG. 12 showing arms of the massage chair in an alternate position.
Figure 21:
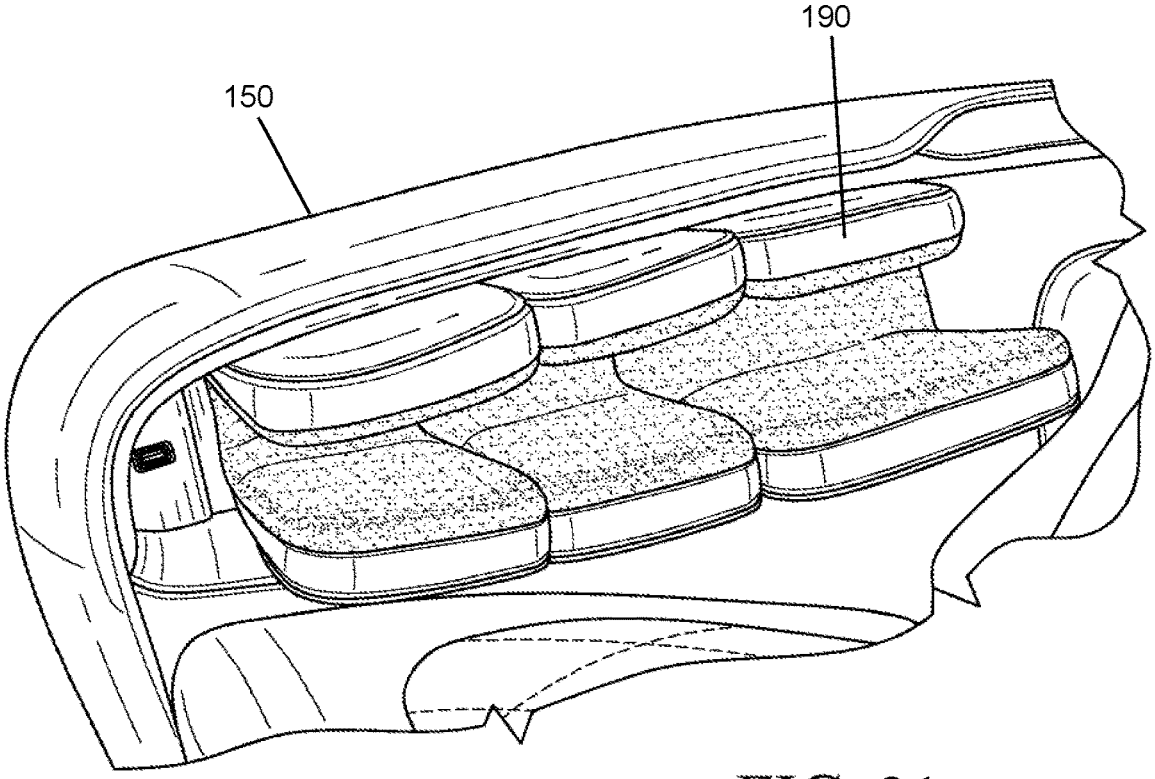
FIG. 21 is an enlarged, fragmentary view of the massage chair in FIG. 12 showing an inner portion of a right arm of the massage chair.
Figure 22:
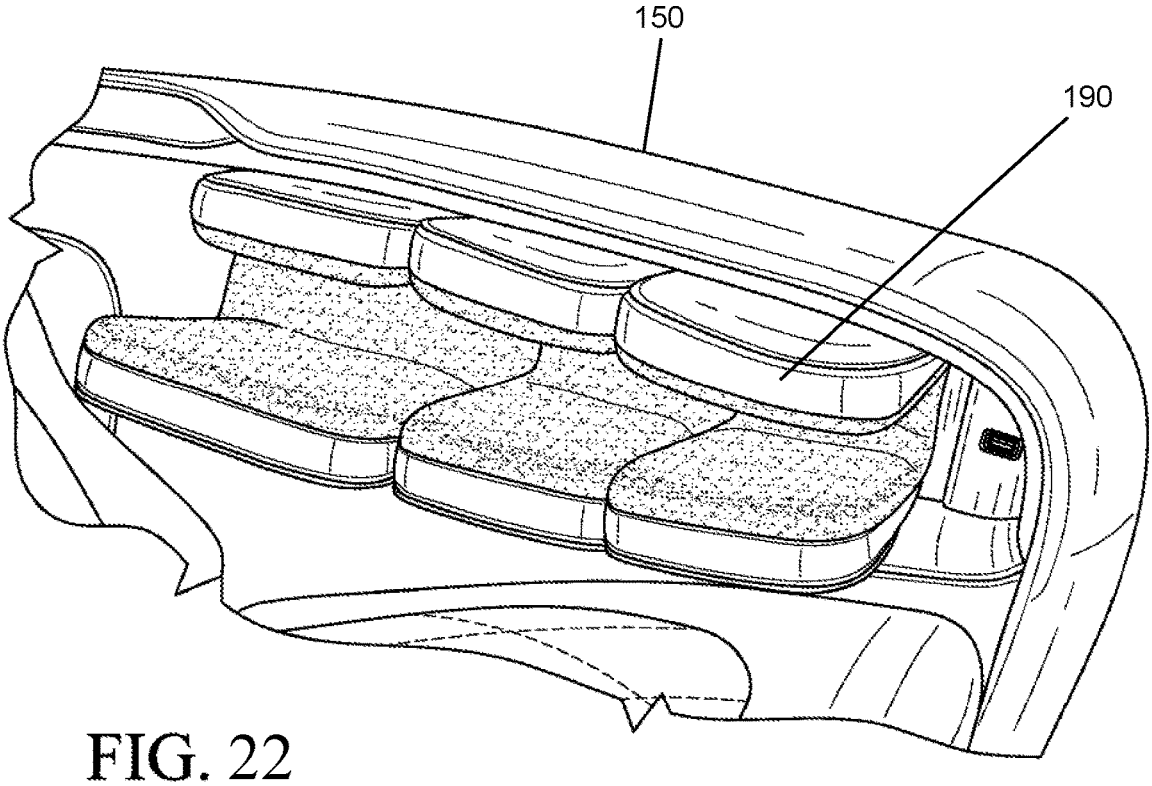
FIG. 22 is an enlarged, fragmentary view of the massage chair in FIG. 12 showing an inner portion of a left arm of the massage chair.

FIGS. 8-9 and 19-20 provide various views of the massage chairs 100 with the arms 150 arranged in an open position 151 and with the base portion 110 in an upright position 153. FIGS. 8 and 19 are front views of the massage chairs 100 with the arms 150 in an open position 151. FIGS. 9 and 20 are rear views of the massage chairs 100 with the arms 150 arranged in an open position 151.

FIGS. 8 and 19 illustrate exemplary connections between the base portion 110 of the massage chairs 150 and the massage chair arms 150. As mentioned above, the arms 150 may be connected to the base portion of the massage chair using two connection points. In certain embodiments, one or more hinges provide a permanent or fixed connection 210 between each arm 150 and the base portion 110. For example, FIGS. 8 and 19 show that each arm 150 may be coupled to the base portion 110 using a hinge that includes three connection points. The hinge allows the arm 150 to rotate between the closed position 152 and the open position 151 as described herein. These figures also show a hard-wired electrical and air connection 230 between the base portion and the arm that can be configured to power and utilize the electrical components included on the arm 150 (e.g., such as the massage component, USB port and/or other electrical components). A latching mechanism provides a releasable connection 220 between the arms 150 and the base portion 110. In this exemplary embodiment, the arms 150 include a female portion of the latching mechanism that is configured to receive and connect to a male portion of the latching mechanism located on the base portion 110. In other embodiments, the base portion 110 may include a female portion of the latching mechanism and the arms 150 may include the male portion of the latching mechanism. Other types of releasable connections 220 may be incorporated into the massage chairs 110 (e.g., which utilizes solenoids, magnets, etc.). As mentioned above, an individual may press a release option 170 (e.g., the release button shown in FIGS. 6 and 17) to release the arms 150 and to transition the arms to an open position 151.

Figure 23A:
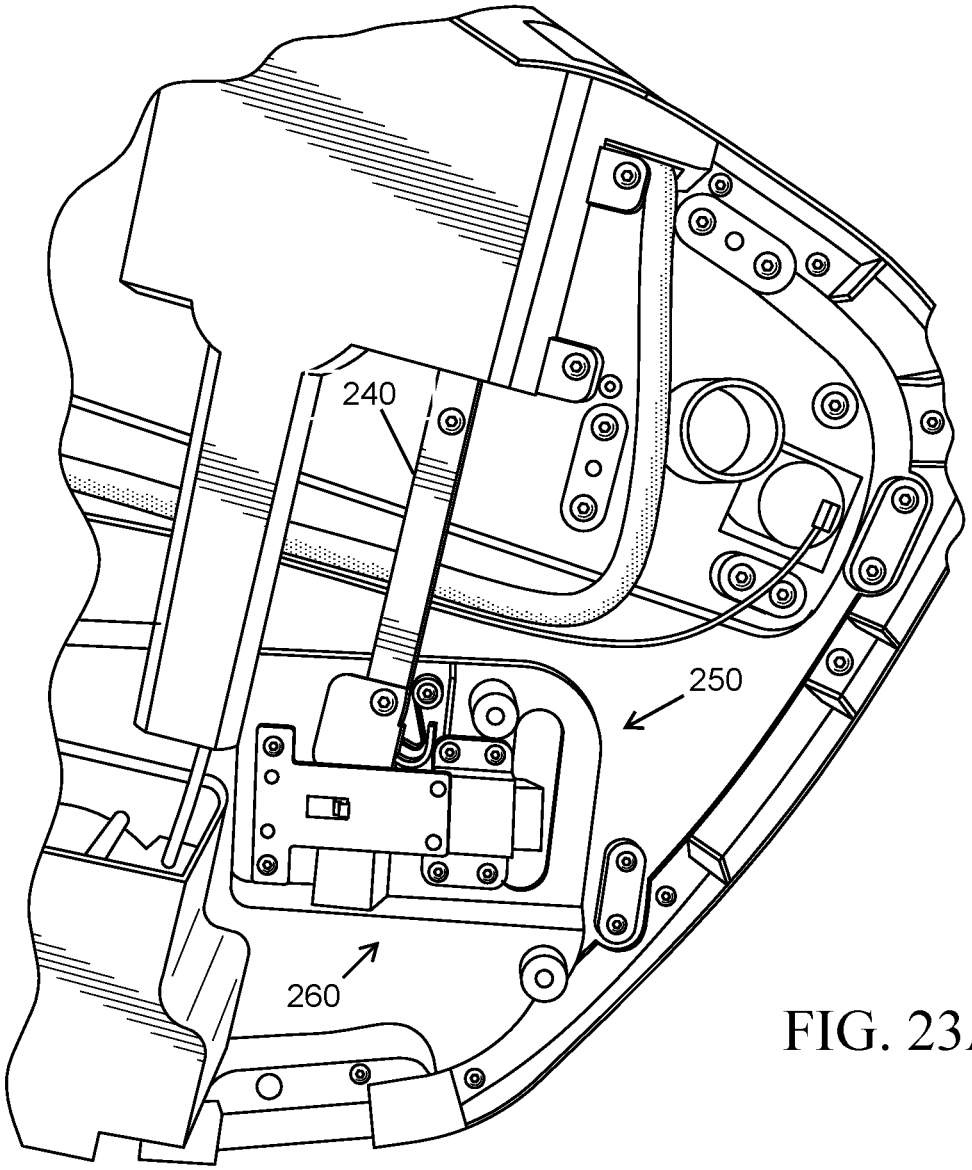
FIG. 23A illustrates internal components of a massage chair arm according to certain embodiments.
Figure 23B:
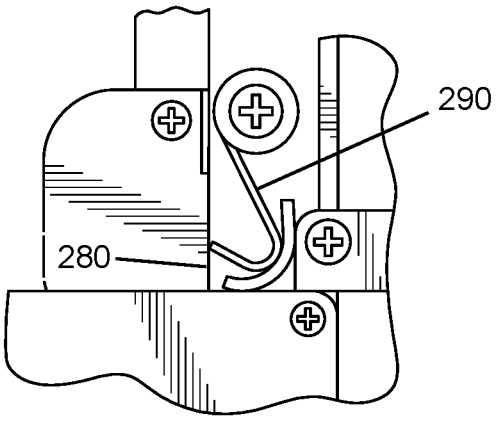
FIG. 23B illustrates an exemplary locking mechanism according to certain embodiments.
Figure 23C:
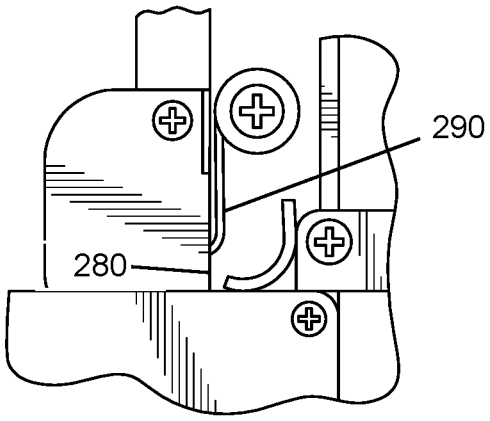
FIG. 23C illustrates an exemplary locking mechanism according to certain embodiments.

FIGS. 23A-23C provide views of an exemplary locking mechanism 250 and latching mechanism 260 that can be incorporated into the chair arms 150 according to certain embodiments. In these figures, the outer casing or housing of the chair arm 150 is not depicted to better illustrate these features. As shown in FIG. 23A, the latching mechanism 260 includes a member 240 that extends downward from the top portion of the chair arm 150 that includes the release option 170. When the release option 170 or button is depressed, the member 240 is moved downward, thus causing a latch connection between the chair arm 150 and the base portion 110 to be unengaged and allowing the chair arm 150 to be released from the base portion 110 when the chair 100 is in an upright position 153. A locking mechanism 250 is located where the member 240 meets the latch connection. As explained above, this locking mechanism 250 can include a rotatable hook 290 that can prevent the chair arm 150 from being released when the chair 100 is in a reclined position 154 and/or when an individual attempts to recline the chair 100.

FIGS. 23B and 23C provide enlarged views of an exemplary locking mechanism 250 and demonstrate two different positions of the hook 290, which can be utilized to lock the chair arms to the base portion 110 of the massage chair. In FIG. 23B, the hook 290 is not engaged, thus allowing the chair arms 150 to be released from the base portion 110. The hook 290 can be found in this position when the base portion 110 of the massage chair 100 is situated in an upright position 153. In FIG. 23C, the hook 290 is received in opening 280 and engaged with the latching mechanism 260, thus preventing the chair arms 150 from being released from the base portion 110. As explained above, the downward movement of the member 240 can cause the latching mechanism 260 to become decoupled or disconnected. When the rotatable hook 290 is received in the opening 280 of the latching mechanism 260, the rotatable hook 290 inhibits or obstructs the member 240 from moving in the downward direction, thus preventing the latching mechanism 260 from becoming decoupled or disconnected. In certain embodiments, the hook 290 may automatically transition from the unengaged position (FIG. 23B) to the engaged position (FIG. 23C) when the massage chair is in a reclined position 154 and/or when the massage chair is being transitioned to a reclined position 154. For example, as the massage chair 100 is transitioned to the reclined position 154, the mechanical configuration of the massage chair 100 can cause the hook 290 to rotate into the opening 290, thus preventing the latching mechanism 260 from being unengaged and locking the arms 150 of the chair 100 to the base portion 110 of the massage chair 100.

In certain embodiments, engaging a single release option 170 will enable both of the arms to be released and transitioned to the open position 151. In other embodiments, two separate release options 170 may be incorporated into the massage chair 100, each of which allows one of the arms 150 to be released and transitioned to the open position 151. Regardless of whether a single release option 170 or multiple release options 170 are incorporated into the massage chair, the release option(s) 170 can allow the chair arms 150 to be disengaged with the base portion 110 of the massage chair 150 when the locking mechanism 250 is not engaged.

The manner in which the release option 170 enables the arms 150 to become disengaged can vary. In certain embodiments, the release option 170 permits an individual to manually disengage the arms 150 using only a mechanical configuration or mechanism (e.g., such that the physical force associated with selecting the release option 170 moves the member 240 in a downward direction or otherwise disengages the latching mechanism 260). Alternatively, or additionally, selection of the release option 170 may activate an electronic or electromechanical mechanism that causes the arms 150 to become disengaged from the base portion 110 of the massage (e.g., such that the electronic or electromechanical mechanism causes the member 240 to move in the downward direction or otherwise causes the latching mechanism 260 to become disengaged). The release option 170 can be configured to disengage the arms 150 in other ways as well.

FIGS. 8 and 19 demonstrate exemplary motion-activated lights 310 according to certain embodiments. In this exemplary embodiment, the motion-activated lights 310 are situated on the bottom portion of the chair arms 150. In certain exemplary embodiments, the motion-activated lights 310 may comprise one or more light-emitting diodes (LEDs). Other types of lighting components (e.g., incandescent, fluorescent, holgen, and/or neon lighting components) may additionally, or alternatively, be incorporated into the massage chairs. FIGS. 1, 3, 4, 12, 14, and 15 illustrate exemplary locations of the motion sensors that activate the motion-activated lights 310. In this exemplary embodiment, two motion sensors 175 are integrated into the support portion 180 of the massage chair beneath each of the chair arms. As mentioned above, the motion-activated lights 310 (and associated sensors 175) provide an additional safety feature that can be useful in situations where the massage chairs 100 are located in areas with poor lighting and/or when the massage chairs 100 are being utilized by individuals with poor vision.

Figure 24:
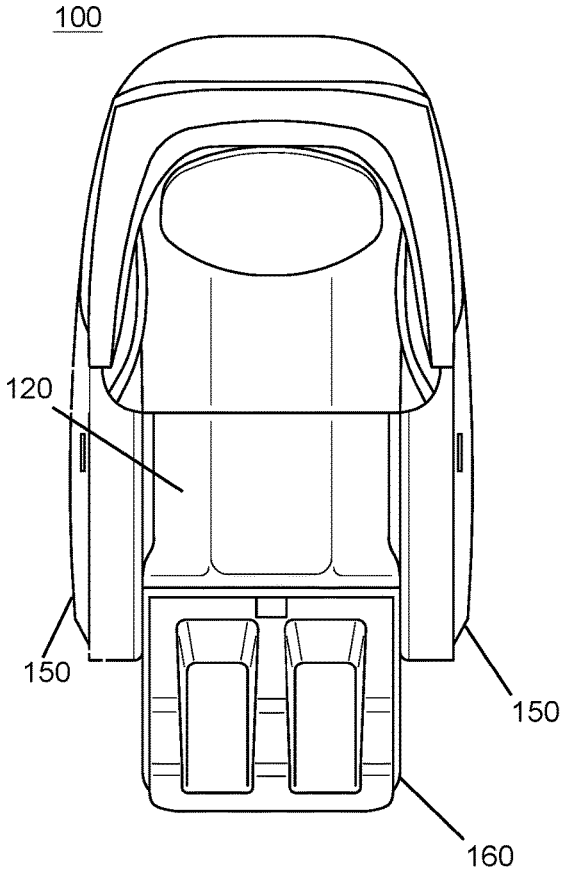
FIG. 24 is a top plan view of another exemplary embodiment of a massage chair.
Figure 25:
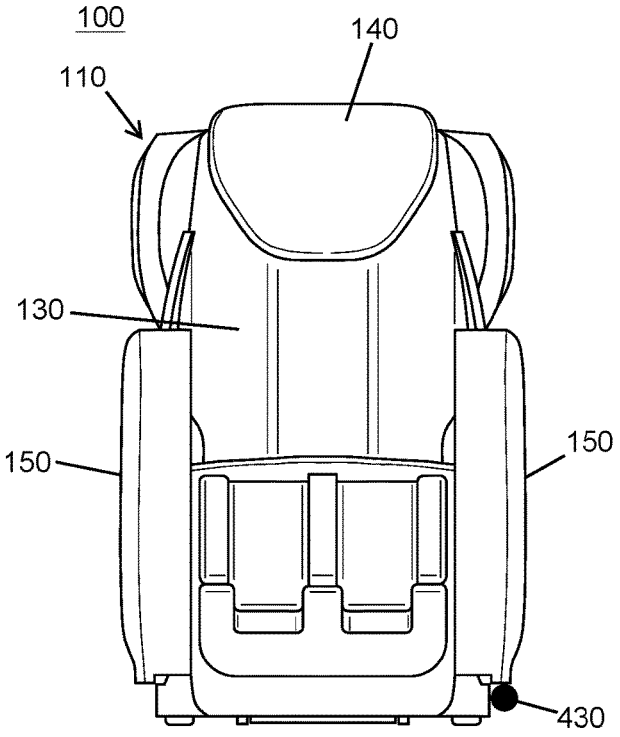
FIG. 25 is a front view of the massage chair in FIG. 24.
Figure 26:
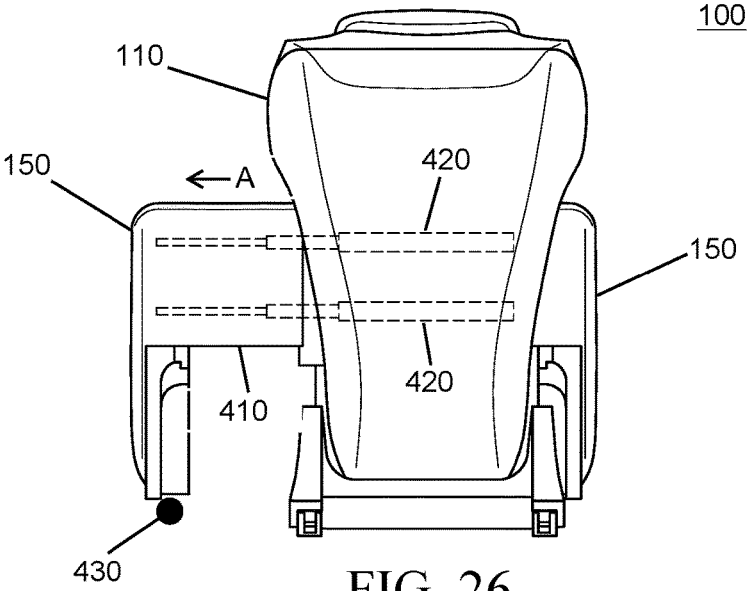
FIG. 26 is a rear view of the massage chair in FIG. 24 showing a chair arm in an alternative position.

FIGS. 24-26 illustrate another exemplary embodiment of a massage chair 100. FIG. 24 shows a top plan view of the massage chair 100 with the chair arms 150 arranged in a closed position 152. FIG. 25 shows a front view of the massage chair 100 with the chair arms 150 arranged in a closed position 152. FIG. 26 shows a rear view of the massage chair 100 with a chair arm 150 arranged in an open position 151.

In this embodiment, one or more of the chair arms 150 can transition between a closed position 152 (e.g., as shown in FIGS. 24 and 25) and an open position 151 (e.g., as shown in FIG. 26). In the closed position 152, a chair arm 150 is attached, or situated immediately adjacent, to the base portion 110 of the chair 100 that includes the backrest and seat. In the open position 151, a chair arm 150 extends outward from the base portion 110 of the chair 100, thus permitting an individual to easily enter or exit the massage chair 100. In certain embodiments, only one of the chair arms 150 is configured to transition between the closed position 152 and an open position 151, and the opposite chair arm 150 remains fixed to the base portion 110. In other embodiments, both of the chair arms 150 are configured to transition between the closed position 152 and an open position 151. In contrast to certain other embodiments disclosed in this application, the chair arms 150 are able to slide or move horizontally, or substantially horizontally, in a lateral direction (e.g., as indicated by arrow A) away from the base portion 110 of the massage chair 100, rather than rotating or swinging away from the base portion 110 of the massage chair 100.

The manner in which the arms 150 of the massage chair 100 transition between open and closed positons can vary. In certain embodiments, the massage chair 100 may include electronic controls that can be utilized to control the chair arms 150 and cause the chair arms 150 to transition between the open and closed positions. The massage chair 100 may alternatively, or additionally, be transitioned between the open and closed positions by mechanical configurations that enable the chair arms to be manually pushed or moved to the open and closed positions.

Each chair arm 150 that is configured to transition between an open and closed position may include an extension portion 410 that connects the inner portion of the chair arm 150 to the base portion 110 of the massage chair 100. The rear housing of the base portion includes an opening that is able to receive and conceal the extension portion 410 of the chair arm 150 when the chair arm 150 is in a closed position (e.g., as shown in FIGS. 24 and 25). When the chair arm 150 is transitioned to an open position 151, the extension portion 410 slides or moves outwardly from the rear housing of the base portion 110 and is exposed (e.g., as shown in FIG. 26). The connection of the chair arm 150 and base portion 110 via the extension portion is a fixed connection 210 that permanently attaches or fixes the arms of the massage chair 100 to the base portion 110 near the backrest. The massage chair 100 may also include a releasable connection 220 (e.g., which utilizes a latching mechanism, magnets, solenoids, and/or other connection schemes) that enables the chair arms 150 to be attached and detached from the base portion 110 of the massage chair (e.g., by pressing or engaging a release option or utilizing electronic controls). The releasable connection 220 may be located near the seat 120 of the massage chair 100 (e.g., in locations shown in FIGS. 8 and 19).

In certain embodiments, the massage chair may utilize one or more sliding rails 420 to facilitate the movement of the chair arms 150 between the open and closed positions. The sliding rails 420 may connect the rear housing of the base portion 110 to the extension portions 410 of the chair arms 150. For example, as shown in FIG. 26, a pair of sliding rails 420 which are at least partially located inside of the base portion 110 may be utilized to facilitate the movement of a chair arm 150. Each of the sliding rails 420 may include one or more telescoping portions that enable the length of the sliding rail 420 to be extended when the chair arm 150 is in an open position 151. The telescoping portions may slide into one another and/or otherwise retract when the chair arm 150 is in a closed position 152. For embodiments in which both chair arms 150 are able to be transitioned to open and closed positions, separate sets of sliding rails 420 can be used to transition each of the chair arms 150. Other configurations can be utilized to transition the chair arms 150 between open and closed positions including, but not limited to, configurations that do not utilize sliding rails 420.

As mentioned above, massage chair 100 may include a locking mechanism 250 that is configured to secure the massage chair arms 150 to the base portion 110 of the massage chair 100 when the massage chair 100 transitions from the upright position 153 to the one or more reclined positions 154. The configuration of the locking mechanism 250 can vary. In certain embodiments, locking mechanism 250 can be controlled electronically (e.g., using electronic switches or controls located on the massage chair to activate and/or deactivate the locking mechanism 250) and/or mechanically (e.g., using mechanical buttons, levers, latching mechanisms, or other options to activate and/or deactivate the locking mechanism 250). In certain embodiments, the locking mechanism 250 can utilize magnets, solenoids, electromagnets, or the like to secure the chair arms 150 to the base portion 110 of the massage chair 100. The locking mechanism 250 may additionally, or alternatively, include mechanical components that grasp, engage, and/or lock the sliding rails 250 in place to prevent movement of the chair arms 150. The locking mechanism 250 may additionally, or alternatively, include latching components (e.g., which may include male and female latching components as described above) to prevent movement of the chair arms 150. Other configurations and designs may be utilized for the locking mechanisms 250. The aforementioned locking mechanisms 250 are not limited to the embodiments disclosed in FIGS. 24-26 and can be incorporated into any of the embodiments described in this disclosure. Regardless of the configuration, the locking mechanism 250 can be configured to secure the massage chair arms 150 to the base portion 110 of the massage chair 100 when the chair arms 150 are situated in a closed position 152 and can prevent the chairs arms 150 from transitioning to an open position 151 when the massage chair 100 is in a reclined position 154 and/or transitioning to a reclined position 154.

In certain embodiments, each of the chair arms 150 that is configured to transition between a closed and open position may include one or more casters 430 or other motion-enabling components which can assist the chair arms 150 with moving or sliding on an underlying surface that supports the massage chair 100. The one or more casters 430 may be located on bottom portions of the chair arms 150 near the underlying surface. The one or more casters 430 may include wheels, rollers, balls, rings, or the like which are able to slide, roll or move across the underlying surface as the chair arms 150 transition between the closed and open positions. In addition to facilitating the movement of the chair arms 150, the one or more casters 430 can assist with supporting the weight of the chair arms 150 and can prevent the chair arms 150 from rotating (e.g., as a result of torque being applied to the chair arms). Again, the aforementioned casters are not limited to the embodiments disclosed in FIGS. 24-26 and can be incorporated into any of the embodiments described in this disclosure.

In certain embodiments, a massage chair comprises: a base portion that comprises a seat and a backrest; a pair of arms that are coupled to the base portion, wherein the pair of arms are configured to transition between a closed position and an open position; releasable connections situated proximate to the seat of the base portion, wherein the releasable connections enable the arms to be secured to the base portion of the massage chair in the closed position and disengaged from the base portion of the massage chair in the open position; and fixed connections situated proximate to the backrest of the base portion, wherein the fixed connections enable the arms to transition from the closed position to the open position when the arms are not engaged with the releasable connections.

In certain embodiments, a massage chair comprises: a base portion that comprises a seat and a backrest; one or more arms coupled to the base portion, wherein the one or more arms are configured to transition between a closed position and an open position; one or more releasable connections situated proximate to the seat of the base portion, wherein the one or more releasable connections enable the one or more arms to be secured to the base portion of the massage chair in the closed position and disengaged from the base portion of the massage chair in the open position; and one or more fixed connections situated proximate to the backrest of the base portion, the one or more fixed connections enable the one or more arms to transition from the closed position to the open position when the one or more arms are not engaged with the one or more releasable connections.

In certain embodiments, a massage chair comprises: a base portion that comprises a seat and a backrest; a pair of arms that are connected to the base portion; wherein: at least one arm included in the pair of arms is configured to transition between a closed position and an open position; the at least one arm is configured to move in a lateral direction away from the base portion of the massage chair to transition to the open position; the at least one arm includes, or is connected to, an extension portion that is received in the base portion of the massage chair when the at least one arm is arranged in the closed position; and the extension portion extends outwardly from the base portion in the lateral direction when the at least one arm is transitioned to the opened position.

While various novel features of the invention have been shown, described and pointed out as applied to particular embodiments thereof, it should be understood that various omissions and substitutions and changes in the form and details of the systems and methods described and illustrated, may be made by those skilled in the art without departing from the spirit of the invention. Amongst other things, the steps in any methods may be carried out in different orders in many cases where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the description of system components are for illustrative purposes to facilitate a full and complete understanding and appreciation of the various aspects and functionality of particular embodiments of the invention as realized in system and method embodiments thereof. Those skilled in the art will appreciate that the invention can be practiced in ways other than the described embodiments, which are presented for purposes of illustration and not limitation. Variations, modifications, and other implementations of what is described herein may occur to those of ordinary skill in the art without departing from the spirit and scope of the present invention and its claims.

What is claimed is:

1. A massage chair comprising:

a base portion that comprises a seat and a backrest;

a pair of arms that are coupled to the base portion, wherein the pair of arms are configured to transition between a closed position and an open position;

releasable connections situated proximate to the seat of the base portion, wherein the releasable connections enable the arms to be secured to the base portion of the massage chair in the closed position and disengaged from the base portion of the massage chair in the open position; and fixed connections situated proximate to the backrest of the base portion, wherein the fixed connections enable the arms to transition from the closed position to the open position when the arms are not engaged with the releasable connections;

wherein:

the base portion of the massage chair is configured to transition between an upright position and a reclined position;

the releasable connections include latching mechanisms;

a hook member is configured to engage at least one of the latching mechanisms in response to the massage chair transitioning from the upright position to the reclined position; and the hook member prevents the at least one latching mechanism from releasing the arms of the massage chair when the massage chair is in the reclined position.

2. The massage chair of claim 1, wherein:

the massage chair further comprises one or more massage components;

the one or more massage components are located in at least one of: the backrest; the pair of arms; or a leg rest portion of the massage chair.

3. The massage chair of claim 1, further comprising:

a release mechanism, wherein:

in response to the release mechanism being engaged when the arms of the massage chair are in the closed position and the base portion is in the upright position, the releasable connections are disengaged and the arms are permitted to rotate to the open position; and engagement of the hook member with the at least one latching mechanism prevents the releasing of the arms of the massage chair when the release mechanism is engaged and the massage chair is situated in the reclined position.

4. The massage chair of claim 1, wherein:

the hook member is configured to transition from an unengaged position to an engaged position;

the pair of arms are capable of being released from the base position of the massage chair when the hook member is in the unengaged position; and the pair of arms are prevented from being released from the base position of the massage chair when the hook member is in the engaged position.

5. The massage chair of claim 4, wherein:

the hook member automatically transitions from the unengaged position to the engaged position when the massage chair is being transitioned from the upright position to the reclined position.

6. The massage chair of claim 1, wherein:

in response to the base portion transitioning from the upright position to the reclined position when the pair of arms are situated in the open position, the pair of arms automatically rotate inwardly towards the base portion and secure the pair of arms to the base portion via the releasable connections.

7. The massage chair of claim 1, wherein:

the massage chair further comprises one or more lighting components and at least one motion sensor; and in response to the at least one motion sensor detecting motion near the massage chair, the one or more lighting components are automatically activated.

8. The massage chair of claim 7, wherein:

the one or more lighting components are located on bottom sides of the arms and are configured to illuminate an underlying surface near the massage chair.

9. The massage chair of claim 1, wherein:

the pair of arms are configured to transition to the closed position in response to the base portion transitioning from the upright position to the reclined position when the pair of arms are situated in the open position.

10. A massage chair comprising:

a base portion that comprises a seat and a backrest;

one or more arms coupled to the base portion, wherein the one or more arms are configured to transition between a closed position and an open position;

one or more releasable connections situated proximate to the seat of the base portion, wherein the one or more releasable connections enable the one or more arms to be secured to the base portion of the massage chair in the closed position and disengaged from the base portion of the massage chair in the open position; and one or more fixed connections situated proximate to the backrest of the base portion, the one or more fixed connections enable the one or more arms to transition from the closed position to the open position when the one or more arms are not engaged with the one or more releasable connections;

wherein:

the base portion of the massage chair is configured to transition between an upright position and a reclined position;

the one or more releasable connections include one or more latching mechanisms;

one or more hook members are configured to engage the one or more latching mechanisms in response to the massage chair transitioning from the upright position to the reclined position; and the one or more hook members prevent the one or more latching mechanisms from releasing the one or more arms of the massage chair when the massage chair is in the reclined position.

11. The massage chair of claim 10, wherein:

the massage chair further comprises one or more massage components; and the one or more massage components are located in at least one of: the backrest; the one or more arms; or a leg rest portion of the massage chair.

12. The massage chair of claim 10, further comprising:

one or more release mechanisms, wherein:

in response to the one or more release mechanisms being engaged when the one or more arms of the massage chair are in the closed position and the base portion is in the upright position, the one or more releasable mechanisms are disengaged and the one or more arms are permitted to rotate to the open position; and engagement of the one or more hook members with the at least one latching mechanism prevents releasing of the one or more arms of the massage chair when the one or more release mechanisms is engaged and the massage chair is situated in the reclined position.

13. The massage chair of claim 10, wherein:

the one or more hook members is configured to transition from an unengaged position to an engaged position;

the one or more arms are capable of being released from the base position of the massage chair when the one or more hook member is in the unengaged position; and the one or more arms are prevented from being released from the base position of the massage chair when the one or more hook members is in the engaged position.

14. The massage chair of claim 13, wherein:

the one or more hook members automatically transitions from the unengaged position to the engaged position when the massage chair is being transitioned from the upright position to the reclined position.

15. The massage chair of claim 10, wherein:

in response to the base portion transitioning from the upright position to the reclined position when the one or more arms are situated in the open position, the one or more arms automatically rotate inwardly towards the base portion and secure the one or more arms to the base portion via the one or more releasable connections.

16. The massage chair of claim 10, wherein:

the massage chair further comprises one or more lighting components and at least one motion sensor; and in response to the at least one motion sensor detecting motion near the massage chair, the one or more lighting components are automatically activated.

17. The massage chair of claim 16, wherein:

the one or more lighting components are located on bottom sides of the one or more arms and are configured to illuminate an underlying surface near the massage chair.

18. The massage chair of claim 10, wherein:

the one or more arms are configured to transition to the closed position in response to the base portion transitioning from the upright position to the reclined position when the one or more arms are situated in the open position.

19. A massage chair comprising:

a base portion that comprises a seat and a backrest;

a pair of arms that are coupled to the base portion, wherein the pair of arms are configured to transition between a closed position and an open position;

releasable connections situated proximate to the seat of the base portion, wherein the releasable connections enable the arms to be secured to the base portion of the massage chair in the closed position and disengaged from the base portion of the massage chair in the open position; and fixed connections situated proximate to the backrest of the base portion, wherein the fixed connections enable the arms to transition from the closed position to the open position when the arms are not engaged with the releasable connections;

wherein:

the base portion of the massage chair is configured to transition between an upright position and a reclined position; and in response to the base portion transitioning from the upright position to the reclined position when the pair of arms are situated in the open position, the pair of arms automatically rotate inwardly towards the base portion and secure the pair of arms to the base portion via the releasable connections.

20. A massage chair comprising:

a base portion that comprises a seat and a backrest;

one or more arms coupled to the base portion, wherein the one or more arms are configured to transition between a closed position and an open position;

one or more releasable connections situated proximate to the seat of the base portion, wherein the one or more releasable connections enable the one or more arms to be secured to the base portion of the massage chair in the closed position and disengaged from the base portion of the massage chair in the open position; and one or more fixed connections situated proximate to the backrest of the base portion, the one or more fixed connections enable the one or more arms to transition from the closed position to the open position when the one or more arms are not engaged with the one or more releasable connections;

wherein:

the base portion of the massage chair is configured to transition between an upright position and a reclined position; and in response to the base portion transitioning from the upright position to the reclined position when the one or more arms are situated in the open position, the one or more arms automatically rotate inwardly towards the base portion and secure the one or more arms to the base portion via the one or more releasable connections.

21. A massage chair comprising:

a base portion that comprises a seat and a backrest;

a pair of arms that are coupled to the base portion, wherein the pair of arms are configured to transition between a closed position and an open position;

releasable connections situated proximate to the seat of the base portion, wherein the releasable connections enable the arms to be secured to the base portion of the massage chair in the closed position and disengaged from the base portion of the massage chair in the open position; and fixed connections situated proximate to the backrest of the base portion, wherein the fixed connections enable the arms to transition from the closed position to the open position when the arms are not engaged with the releasable connections;

wherein:

the base portion of the massage chair is configured to transition between an upright position and a reclined position; and the pair of arms are configured to transition to the closed position in response to the base portion transitioning from the upright position to the reclined position when the pair of arms are situated in the open position.

22. A massage chair comprising:

a base portion that comprises a seat and a backrest;

one or more arms coupled to the base portion, wherein the one or more arms are configured to transition between a closed position and an open position;

one or more releasable connections situated proximate to the seat of the base portion, wherein the one or more releasable connections enable the one or more arms to be secured to the base portion of the massage chair in the closed position and disengaged from the base portion of the massage chair in the open position; and one or more fixed connections situated proximate to the backrest of the base portion, the one or more fixed connections enable the one or more arms to transition from the closed position to the open position when the one or more arms are not engaged with the one or more releasable connections;

wherein:

the base portion of the massage chair is configured to transition between an upright position and a reclined position; and the one or more arms are configured to transition to the closed position in response to the base portion transitioning from the upright position to the reclined position when the one or more arms are situated in the open position.

* * * * *